US008277642B2

(12) United States Patent
Ryu

(10) Patent No.: US 8,277,642 B2
(45) Date of Patent: Oct. 2, 2012

(54) SYSTEM FOR SEPARATING BITUMEN FROM OIL SANDS

(75) Inventor: Hyunjoo Ryu, Seoul (KR)

(73) Assignee: Korea Technology Industries, Co., Ltd. (KR)

( * ) Notice: Subject to any disclaimer, the term of this patent is extended or adjusted under 35 U.S.C. 154(b) by 660 days.

(21) Appl. No.: 12/476,729

(22) Filed: Jun. 2, 2009

(65) Prior Publication Data

US 2009/0294332 A1 Dec. 3, 2009

Related U.S. Application Data

(60) Provisional application No. 61/057,915, filed on Jun. 2, 2008.

(51) Int. Cl.
*C10G 1/04* (2006.01)
*B01D 11/02* (2006.01)
*C01C 3/08* (2006.01)

(52) U.S. Cl. ..... 208/390; 196/14.52

(58) Field of Classification Search ..... 196/14.52; 208/390

See application file for complete search history.

(56) References Cited

U.S. PATENT DOCUMENTS

| | | | | |
|---|---|---|---|---|
| 2,910,424 | A | 10/1959 | Tek et al. | |
| 3,153,626 | A * | 10/1964 | Kulik | 208/22 |
| 3,392,105 | A | 7/1968 | Poettmann et al. | |
| 3,521,756 | A * | 7/1970 | Kaminsky | 210/521 |
| 4,139,450 | A | 2/1979 | Hanson | |
| 4,347,118 | A | 8/1982 | Funk et al. | |
| 4,422,901 | A | 12/1983 | Karnofsky | |
| 4,702,487 | A | 10/1987 | Stoian et al. | |
| 4,859,323 | A | 8/1989 | Rolfvondenbaumen | |
| 4,994,175 | A | 2/1991 | Hargreaves | |
| 5,039,227 | A | 8/1991 | Leung et al. | |
| 5,534,136 | A | 7/1996 | Rosenbloom | |
| 5,772,127 | A | 6/1998 | Maciejewski et al. | |

(Continued)

FOREIGN PATENT DOCUMENTS

CA 637941 3/1962

(Continued)

OTHER PUBLICATIONS

International Search Report for PCT/IB09/052326, mailed Feb. 17, 2010.

(Continued)

*Primary Examiner* — Randy Boyer
(74) *Attorney, Agent, or Firm* — Brinks Hofer Gilson & Lione

(57) ABSTRACT

Disclosed is a system for processing oil sands to remove bitumen, the viscous petroleum product adhered to the sands, from the sands itself. The processing system is designed to be substantially air tight, preventing outside air from entering and volatile chemicals from escaping from the system. Mined oil sands are delivered to the system, which creates a slurry of oil sands and solvent in a slurry chamber. The slurry is transported to a dissolution chamber which conditions the slurry before the slurry is sent to an extraction chamber. A plurality of trays and scrapers further conditions the slurry to remove bitumen. The use of heavy, aromatic solvents and light, paraffinic solvents in sequence improves bitumen recovery while allowing environmentally safe processing of the sands to occur in a later step. The sands are dried and the solvent recovered for recycling and reuse in the system. Clean, dry sands are returned to the source of mined oil sands for reclamation.

38 Claims, 12 Drawing Sheets

U.S. PATENT DOCUMENTS

| | | | |
|---|---|---|---|
| 6,027,056 | A | 2/2000 | Maciejewski et al. |
| 2006/0043005 | A1 | 3/2006 | Cleminson et al. |
| 2007/0090025 | A1 | 4/2007 | Strand |
| 2008/0060978 | A1 | 3/2008 | Wegner |

FOREIGN PATENT DOCUMENTS

| | | |
|---|---|---|
| CA | 639713 | 4/1962 |
| CA | 653582 | 12/1962 |
| CA | 2521248 | 3/2007 |
| CA | 2480122 | 12/2010 |
| CN | 1778870 | 5/2006 |
| JP | 2007186659 | 7/2007 |
| WO | 2007102819 | 9/2007 |
| WO | 2007146992 | 12/2007 |

OTHER PUBLICATIONS

Written Opinion for PCT/IB09/052326, mailed Feb. 17, 2010.
International Preliminary Report on Patentability for PCT/IB2009/052326, mailed Dec. 6, 2010.

* cited by examiner

SYSTEM FOR SEPARATING BITUMEN FROM OIL SANDS

PRIORITY CLAIM

This non-provisional application claims the priority and the benefit of U.S. Provisional Patent Application 61/057,915 filed Jun. 2, 2008, which is incorporated herein for all purposes by this reference.

FIELD

This invention relates to the processing of oil sands. Oil sands are typically mixed with clay, water, and bitumen. Bitumen is a form of heavy oil, typically with a specific gravity below 20° on the American Petroleum Institute (API) scale and a viscosity above 10,000 centipoise (cP) at 60° F., where centipoise is a centimeter-gram-second system unit equal to 1 mPa·s in the International System of Units (SI). Oil sands are typically found in deposits near the surface that are mined. The oil sands are then processed to remove the bitumen, which can be refined into commercially useful hydrocarbon products, and the sands cleaned so that it may be returned to the earth.

BACKGROUND

Deposits of oil sands are found around the world, but most prominently in Canada, Venezuela, and the United States, most significantly in Utah. These oil sands contain significant deposits of heavy oil, typically referred to as bitumen. The bitumen from these oil sands may be extracted and refined into synthetic oil or directly into petroleum products.

The difficulty with bitumen lies in that it typically is very viscous, sometimes to the point of being more solid than liquid. Thus, bitumen typically does not flow as less viscous, or lighter, crude oils do.

Because of the viscous nature of bitumen, it cannot be produced from a well drilled into the oil sands as is the case with lighter crude oil. This is so because the bitumen simply does not flow without being first heated, diluted, or upgraded.

Since normal oil drilling practices are inadequate to produce bitumen, several methods have been developed over several decades to extract and process oil sands to remove the bitumen. For shallow deposits of oil sands, a typical method includes surface extraction, or mining, followed by subsequent treatment of the oil sands to remove the bitumen.

The development of surface extraction processes has occurred most extensively in the Athabasca field of Canada. In these processes, the oil sands are mined, typically through strip or open pit mining with draglines, bucket-wheel excavators, and, more recently, shovel and truck operations. The oil sands are then transported to a facility to process and remove the bitumen from the sands. These processes typically involve a solvent of some type, most often water or steam, although other solvents, such as hydrocarbon solvents, have been used.

After excavation, a hot water extraction process is typically used in the Athabasca field in which the oil sands are mixed with water at temperatures ranging from approximately 110° F. to 180° F., with recent improvements lowering the temperature necessary to the lower portion of the range. A surfactant, such as sodium hydroxide (NaOH), or other surfactants, and air are also mixed with the oil sands.

Adding the water and NaOH to the oil sands creates a slurry, which is then transported to an extraction plant, typically via a pipeline. Inside a separation vessel, the slurry is agitated and the water and NaOH releases the bitumen from the oil sands. Air entrained with the water and NaOH attaches to the bitumen, allowing it to float to the top of the slurry mixture and create a froth. The bitumen froth is further treated to remove residual water and fines, which are typically small sand and clay particles. The bitumen is then either stored for further treatment or immediately treated, either chemically or mixed with lighter petroleum products, and transported by pipeline for upgrading into synthetic crude oil.

This process removes approximately 75% of the bitumen. Additional treatments applied to the oil sands may remove another 10% to 20% of the bitumen from the sands. The relatively clean sands (as compared to the oil sands) are then returned to the mine, typically in the form of tailing piles. Because some bitumen, NaOH, or other hazardous materials may remain on the relatively clean sands, the sands must be further treated or stored in tailings piles that have protections to prevent any of the hazardous materials from leaching into the ground or nearby water sources.

Another method of extracting bitumen from oil sands includes a hydrocarbon-based solvent extraction process in which a solvent or mixture of solvents flows counter-current to a slurry of oil sand and solvent in a processor. The solvent helps separate the bitumen from the sand and the solvent-bitumen mixture is drawn off from the top of the processor while sands with any remaining bitumen and solvent exit from the bottom of the processor.

While the known methods of extracting bitumen from oil sands work well with certain deposits of oil sands, those same processes often work poorly with deposits of oil sands that have different characteristics. For example, the processes that use water typically work poorly with oil sands that have a high concentration of clay mixed within the oil sands. The water may bind with the clay, causing the clay to swell and clog pipes, fittings, and other processing machinery. Further, a significant volume of water is required when used as a solvent, which may not always be available at a location because of permitting requirements or simply the arid nature of a region in which the oil sands are located. Large pits or basins to store water, both before and after use when the water is polluted with bitumen and other chemicals are often required. Air, water, and ground pollution concerns, not to mention the large space required, often make this unfeasible. In addition, any water used must be treated to remove impurities and other pollutants, which typically is an expensive process.

Hydrocarbon-based solvent extraction processes may not always be suitable for a variety of reasons, too. First, air quality concerns often limit the use of hydrocarbon solvents because the evaporation of those solvents adversely affects air quality. In addition, solvent processes typically cost significantly more because of the cost and the large volume of solvent required. Pollution concerns often require special handling and disposal of these solvents, including those solvents that remain on the sand after processing, to prevent air, water, and ground pollution.

Therefore, an environmentally sound method of extracting bitumen for oil sands is required that addresses the short comings in previous methods of processing oil sands.

SUMMARY

Oil sands that include bitumen are first mined from an oil sand source. The oil sands, with larger clumps and pieces of oil sands and rock crushed into smaller pieces, are deposited into a slurry chamber and mixed with a liquid or liquids, which may include solvents, to form a slurry that can be pumped via pipe to other parts of a processing facility. The slurry chamber optionally is designed to minimize or prevent outside air from entering into the system and minimize or prevent any volatile chemicals within the system from escaping.

The slurry optionally is pumped to a dissolution chamber in which the slurry is treated with a water- or hydrocarbon-based solvent to begin removing the bitumen from the oil sands, creating a froth of bitumen, solvent and fine solids. The slurry optionally passes through a screen and is further processed with an agitator to further reduce the oil sands and larger clumps into smaller pieces.

From the dissolution chamber, the slurry is pumped to an extraction chamber in which the slurry and froth is treated with solvent. A light, paraffinic solvent such as hexane or a mixture of hexane with bitumen can be used to remove the bitumen from the oil sands. Alternatively, diesel can be used as a solvent. The slurry falls under the influence of gravity to a plurality of trays with openings therein. Scrapers push the slurry to the openings in a tray, causing the slurry to again descend under the influence of gravity to another tray with openings that are offset from the openings in the first tray. Another scraper pushes the slurry towards the openings in the second tray. The process removes the bitumen from the sands, with the less dense bitumen and solvent rising towards the top of the extraction chamber and forming what is typically referred to as a froth. The bitumen and solvent froth is extracted from the extraction chamber. The solvent-wetted sands exit the extraction chamber via a substantially air tight valve to a vacuum conveyor and dryer.

Another embodiment of the extraction chamber uses a heavy, aromatic solvent that is injected in first extraction/rinsing section of the extraction chamber. The heavy solvent removes most of the bitumen from the oil sand and treats the froth and the slurry. The slurry is conditioned with a plurality of trays and scrapers as described above.

The slurry descends under the influence of gravity and the action of the scrapers to a second extraction/rinsing section of the extraction chamber, into which a light, paraffinic solvent is injected. The light, paraffinic solvent has a lower distillation point than the heavy solvent and is therefore easier to vaporize during subsequent processing of the sands. The light, paraffinic solvent strips the heavy solvent from the sands. The light solvent-wetted sands exit the extraction chamber via a substantially air tight valve to a vacuum conveyor and dryer.

The froth containing the heavy solvent and bitumen is extracted from proximate the top of the extraction chamber and sent to a solvent recovery system that separates recoverable solvent from the bitumen. A portion of the bitumen is used in the system while another portion is sent for processing into synthetic crude oil or to storage.

The solvent-wetted sands are processed in a vacuum conveyor and a dryer to vaporize and substantially remove any remaining solvent from the sands. The vaporized solvent is recovered through a vapor solvent recovery system and an absorber to strip the light vapor solvent from a circulating inert gas.

The clean, dry sands are stored for use as either backfill to reclaim the land disrupted during the mining of the oil sands, as construction material, as proppant in fracturing fluids used in the oil and gas industry, and other uses known in the art.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

The drawings are not necessarily to scale.

DETAILED DESCRIPTION

"Oil sands" or "tar sands" are the common terms for what are formally known as "bituminous sands". Oil sands are naturally occurring mixtures of sand and a viscous form of petroleum called bitumen. Oil sands often include clay, silt, water, and other minerals and liquids. Oil sands are a major source of what is referred to as non-conventional oil. Non-conventional oil is termed as such because it typically cannot be extracted through the use of oil wells as is the case with conventional oil reservoirs.

Figure 1:
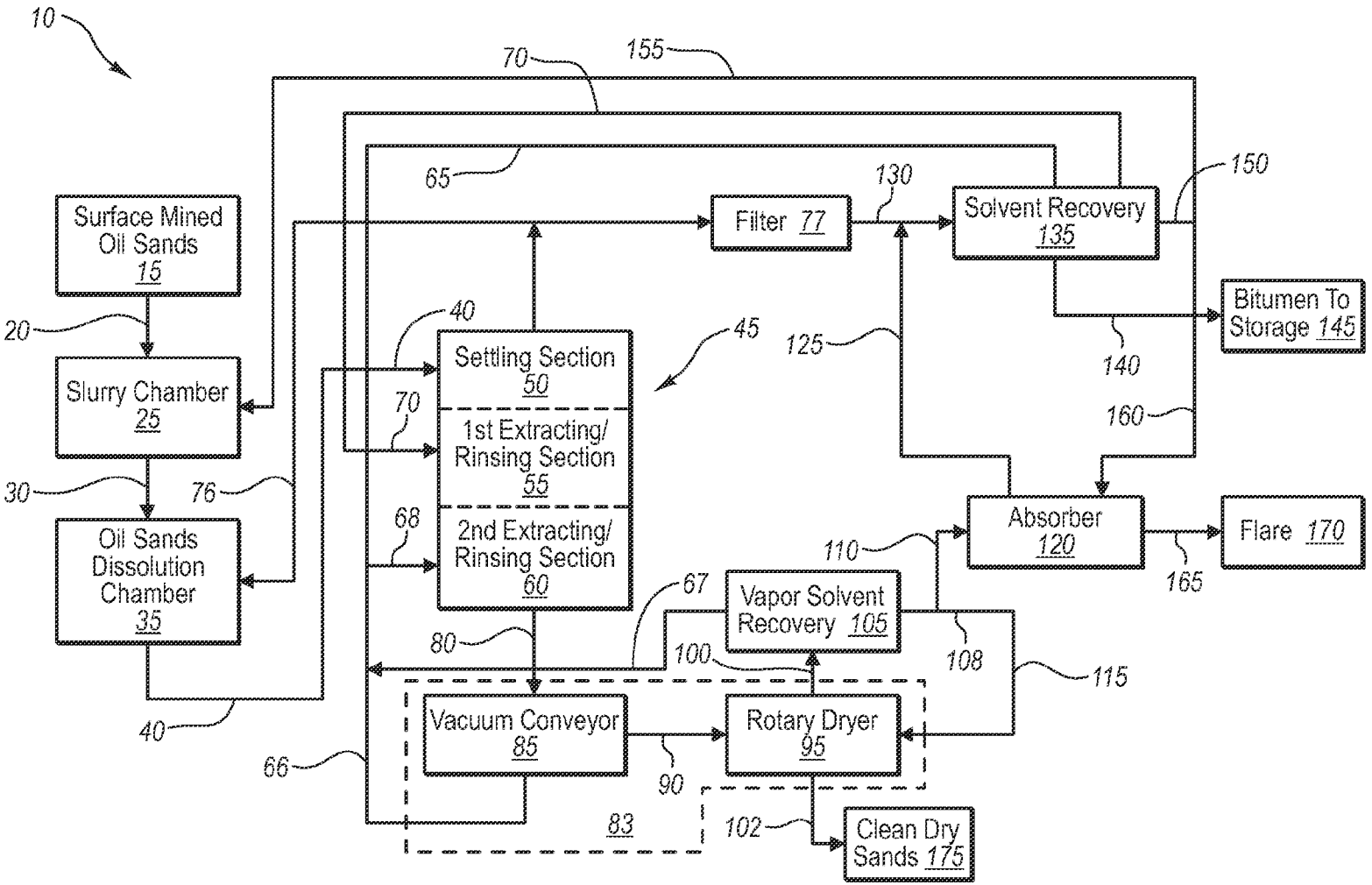
FIG. 1 depicts an embodiment of the system for processing oil sands in a block diagram.
Figure 2:
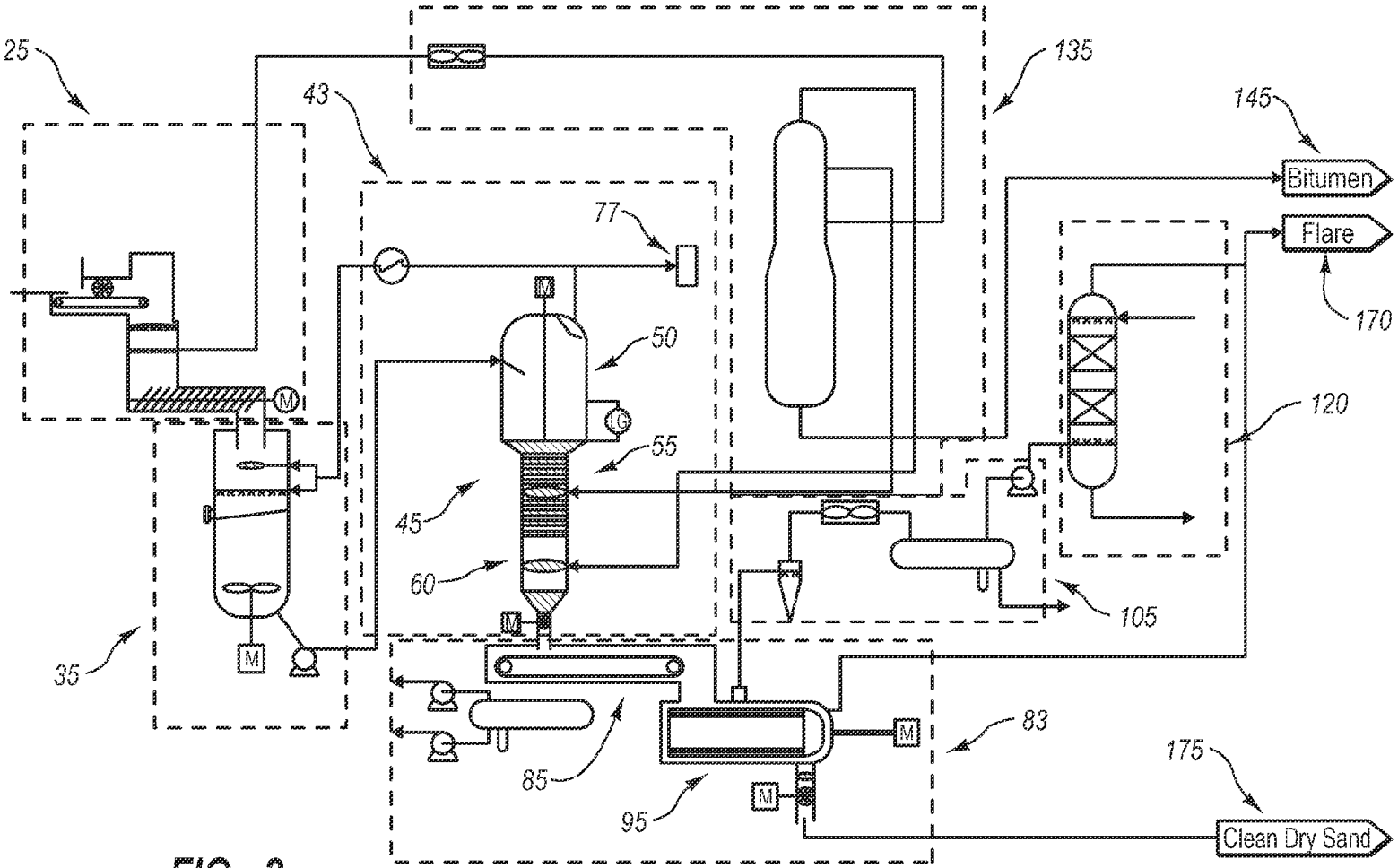
FIG. 2 depicts an embodiment of the system with embodiments of major subsystems identified.

Illustrated in FIG. 1 is a block outline of an embodiment of the processing system 10 of the invention; FIG. 2 depicts various embodiments of subsystems of FIG. 1 in greater detail as outlined in the dotted boxes. (The subsystems are illustrated in greater detail in FIGS. 3 through 9, which are discussed below.) To be useful as a source of petroleum, the bitumen must first be removed from the oil sands to which it is attached. In ex situ methods of extracting the bitumen, the oil sands are typically excavated or mined from shallow deposits and delivered to a processing facility near the deposits of oil sands, depicted at 15. The method of mining and transporting 20 the oil sands to the processing site vary, but are not germane to the invention.

Once mined, the oil sands are optionally delivered to a slurry chamber 25 where the oil sands are mixed with a solvent or solvents and treated mechanically to form a slurry that can be pumped through the processing system 10. The solvent, which can include one or more solvents, such as water (including fresh water, brine, salt water, recycled or reclaimed water, and/or water with various additives and/or solids therein), one or more heavy distillates (i.e. having a higher distillation point or temperature than hexane) or heavy petroleum products, other known solvents, and/or mixtures thereof, is injected into the slurry chamber 25 through line 155. Non-limiting examples of the heavy distillate solvents include diesel, heavy fuel oil, mixtures of bitumen and other solvents, and others. A physical characteristic that these examples of the heavy distillate solvents share is a low volatility, which means that the solvent does not vaporize at low temperatures easily.

Optionally, the slurry is fed via line 30 to a dissolution chamber 35, in which additional solvent such as those described above is added through line 76 to the slurry. The slurry is further treated mechanically to reduce the size of the sand and other particulates within the slurry. (The connection lines, such as line 30 are idealized representations of physical structure, typically industrial piping of some sort, but also including conveyors, valves and other connections, as one having ordinary skill in the art understands.) The solvent (such as those described above) applied in the dissolution chamber begins the process of removing the bitumen from the oil sands to create a froth of bitumen, solvent, and, typically, some fine solids. (While some dissolution of the bitumen from the oil sands occurs in the slurry chamber as the water and/or heavy distillate solvent is added, significantly more dissolution occurs in the dissolution chamber.) Non-limiting examples of the solvent include water, heavy solvents such as bitumen extracted from the oil sands in other systems of the process, and other hydrocarbons, such as diesel, heavy fuel oil, and mixtures of these and other hydrocarbons as described above.

From the slurry chamber 25 or, if optionally passed through the dissolution chamber 35, the slurry is pumped via a line 40, typically a pipe configured to pump highly erosive slurry, to an extraction system 43, which includes an extraction chamber, or vessel, 45. The extraction chamber, or vessel, 45 includes a plurality of sections, although it is understood that these sections do not necessarily have discrete boundaries and are merely identified as such for clarity. The embodiment illustrated includes three sections, although more or fewer sections may be present. Further, while the embodiment of the extraction chamber 45 is illustrated with various subsystems both before and after the extraction chamber 45, one having skill in the art would understand that the extraction chamber 45 is capable of being used with other subsystems and combinations, both before and after, to treat the bitumen froth and the slurry.

The first section is a settling section 50 near the upper portion of the extraction chamber, or vessel, 45. The settling section 50 is where the slurry settles to a degree, which means that a portion of the bitumen, solvents, and other liquids rise towards the top of the extraction chamber or vessel, 45 as a froth while the sand and other solids settle or descend under the influence of gravity towards the bottom of the extraction chamber, or vessel, 45.

The second section is the first extracting/rinsing section 55 and lies below the settling section 50 in the extraction chamber, or vessel, 45. Heavy solvents, such as aromatics (i.e., those solvents whose chemical formula includes a benzene ring) are injected through line 70 into the first extracting/rinsing section 55. The heavy solvent mixes with the oil sands in the slurry in the first extracting/rinsing section 55 and removes a substantial portion of the bitumen from the oil sands and dilutes the bitumen. As the sands from which most of the bitumen has been removed descends in the extraction chamber 45 under the force of gravity, bitumen and the heavy solvent rises towards the top as a froth. The descending sands are now wetted with the heavy solvent (and some bitumen) and referred to as heavy solvent-wetted sands and descend under the force of gravity in the first extraction/rinsing section 55.

A second extracting/rinsing section 60 lies below the first extracting/rinsing section 55. Light solvents are injected through line 68 into the second extracting/rinsing section 60. These light solvents are lighter than the heavy solvents injected into the first extracting/rinsing section 55. Light solvents include paraffinic solvents, i.e., those solvents whose chemical formula includes a single-bond carbon chain. The light solvents also have a higher vapor pressure than the heavy solvents. That is the light solvents have a lower distillation point than the heavy solvents and therefore vaporize at a lower temperature than the heavy solvents. The light solvents remove substantially all of the heavy solvent and any bitumen remaining on the heavy solvent-wetted sands. The remaining heavy solvent and bitumen rises towards the top of the extraction chamber, or vessel, 45 as a froth. The sands are now substantially free of heavy solvent and bitumen and are wetted only with the light solvent and are referred to as light solvent-wetted sands.

The froth of heavy solvent and bitumen that rises to the top of the extraction chamber, or vessel, 45 is drawn off via line 75, such as a conduit, valve, passage, pipe, or other connection through which the heavy solvent and bitumen can flow. A portion of the froth of the heavy solvent and bitumen is sent via line 76 to the dissolution chamber 35 and another portion is sent via line 76 through a filter configured to remove fine (i.e., small diameter) silt, sand, and other solids from the froth of heavy solvent and bitumen before being sent via line 78 and 130 to a solvent recovery system 135.

Returning to the extraction chamber, or vessel, 45, the light solvent-wetted oil sands are removed from the lower portion of the extraction chamber, or vessel, 45 and the second extracting/rinsing section 60 via a valve (discussed in more detail below) and through line 80 to the clean sand drying system 83, which includes a vacuum conveyer 85 and a rotary dryer 95.

Line 80 first delivers the light solvent-wetted sands to the vacuum conveyer 85. A vacuum draws off a portion of the light solvent from the light solvent-wetted sands and delivers a portion of the light solvent via line 66 to line 68, where the light solvent is reinjected into the second extracting/rinsing section 60 as discussed above.

The vacuum conveyor 85 delivers the remaining light solvent-wetted sands via line 90 to the rotary dryer 95. The rotary dryer 95 applies heat to the light solvent-wetted oil sands to vaporize any light solvent remaining on the sands. Before the clean sands exits the rotary dryer 95, inert gas is optionally injected via line 115 into the rotary dryer 95. The inert gas acts to strip any remaining light solvent adhered to the sands. The vaporized light solvent and circulating inert gas is removed from the rotary dryer 95 via line 100 and sent to a vapor solvent recovery system 105. Clean dry sands 175 exit the rotary dryer via line 102.

The vapor solvent recovery system 105 condenses the light solvent for reuse within the entire process. The light vapor solvent recovered as liquid is sent via line 67 to intersect with the light solvent in line 66, which is delivered via line 68 to the second extracting/rinsing section 60. The light vapor solvent unrecovered is sent via line 108 to line 110, which delivers the solvent to an absorber system 120.

The absorber system 120 strips the light vapor solvent delivered via line 110 from the vapor solvent recovery system 105 from any circulating inert gas. Excess inert gases optionally are flared, or vented to the atmosphere, at 170. Heavy distillate arrives at the absorber system 120 from the solvent recovery system 135 via line 160. The heavy distillate removes the light solvent that arrives via line 110, with the heavy distillate and light solvent being sent via line 125 to intersect with the bitumen and heavy solvent from the filter 77 via line 78. The combined bitumen/heavy solvent and heavy distillate/light solvent is then sent to the solvent recovery system 135.

The solvent recovery system 135 is configured to separate the bitumen from the heavy and light solvents that it receives via line 130. The solvent recovery system 135 delivers heavy solvents and aromatics via line 70 to the first extracting/rinsing section 55 of the extraction chamber, or vessel, 45. The solvent recovery system 135 also delivers light solvents and paraffinics via line 65 to the second extraction/rinsing section 60 of the extraction chamber, or vessel, 45. Heavy distillates are sent from the solvent recovery system 135 via line 150, which branches into line 155, via which heavy distillates optionally are delivered to the slurry chamber 25, and line 160, which delivers heavy distillates to the absorber system 120. The solvent recovery system 135 also delivers the separated bitumen 145 to storage via line 140.

Figure 3:
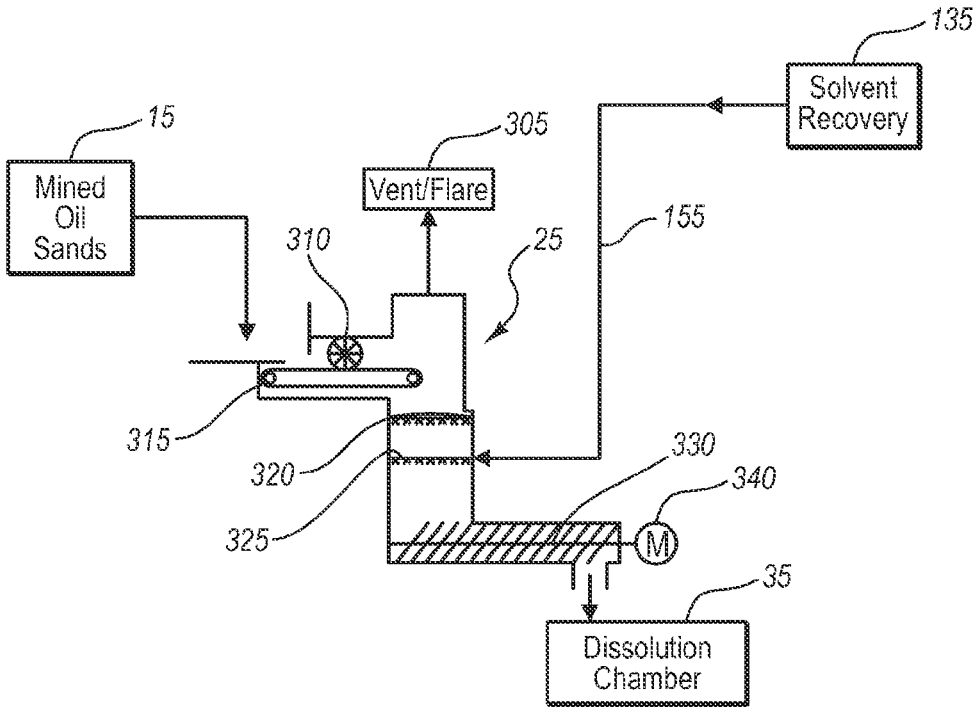
FIG. 3 depicts an embodiment of a slurry chamber used in an embodiment of the system.

FIG. 3 depicts an enlarged view of an embodiment of the optional slurry chamber 25 from FIGS. 1 and 2. Mined oil sands 15 are delivered to the slurry chamber 25. The sands can be delivered directly via truck, conveyor, pipeline (if previously formed into a slurry) and other methods known in the art. The oil sands 15 optionally enter through a feeder-breaker 310 that crushes and breaks the incoming oil sands 15 into smaller pieces and optionally prevents any significant amount of ambient (outside) air from entering into the slurry chamber 25. While it is not necessary to prevent air from entering into the slurry chamber 25, it is preferred to minimize or prevent air from entering into the slurry chamber 25 (and the system beyond) because it reduces or removes the presence of oxygen that could be consumed should any of the inflammable gases and liquids in the processing system 10 ignite. Additionally, while a feeder-breaker 310 prevents outside air from entering, it also reduces or eliminates the release of any solvents, volatile hydrocarbons, and other vapors into the air. Not only is reducing or eliminating the amount of solvents, volatile hydrocarbons, and other vapors that escape one consideration as part of reducing the economic cost of operating the system 10—any solvent lost to the atmosphere cannot be recycled and reused in the system, but has to be purchased and added—it also reduces the environmental impact and air pollution. The latter reason is a consideration not only for protecting the air quality near the processing facility and the environment nearby, but it also may be a necessary requirement to receive operating permits under various regulatory schemes. The feeder-breaker 310 includes a valve depicted in FIG. 3 that is a rotary-type valve, as known in the art, but it will be appreciated that valves of other types fall within the scope of the disclosure.

A conveyor 315 optionally transports deposited oil sands 15 to the feeder-breaker 310. While FIG. 3 depicts a horizontal arrangement, it is understood that the slurry chamber 25 can be configured vertically in a bin arrangement (not illustrated) in which the oil sands 15 are deposited in a bin and descend vertically under the force of gravity to a feeder-breaker 310 at the bottom of the bin, which allows the oil sands to pass through the feeder-breaker 310 and into the slurry chamber 25.

In either arrangement, it is preferable, although not necessary, to provide a sufficient volume of oil sands at the feeder-breaker 310 and conveyor 315 such that the oil sands provides a partial, mechanical barrier to the entrance of outside air and the escape of vapors and solvents from within the slurry chamber 25.

Once entering the slurry chamber 25, the oil sands 15 optionally pass through an inert gas or gases injected at a first sprayer or sparger 320. The inert gas, typically nitrogen, carbon dioxide, a mixture thereof, or other inert gases, acts to strip oxygen and other ambient air that entered with the oil sands 15 through the feeder-breaker 310. The inert gas and ambient air can be removed via a flare or vent 305 and vented directly to the atmosphere or it can be sent to be recycled, treated, scrubbed, or handled in other known ways to reduce pollution and cost.

The oil sands 15 optionally are treated with a solvent, such as water (hot or cold, in terms of temperature, and of the several types of water described above) or hydrocarbon-based solvents as described above. For example, the solvent can include a heavy distillate in the slurry chamber 25 as discussed above. The heavy distillate is delivered into the slurry chamber 25 via a second sprayer or sparger 325. The heavy distillate arrives at the slurry chamber 25 via line 155 from the solvent recovery system 135. The heavy distillate (or water, in the case of a water based conditioning program or process is employed) begins the process of conditioning the oil sand 15 and, possibly, removing some bitumen from the oil sands, but, more importantly, it provides a sufficient liquid base to form a slurry of the solvent, oil sand 15, and other materials so that it may be transported throughout the processing system 10.

The slurry of oil sands and solvent optionally are transported via a screw conveyor 330 that is operably connected to a motor 340 that provides the motive force to turn the screw conveyor 330. The motor 340 is typically an electric motor as known in the art, but hydraulic motors and other types of motors known fall within the scope of the disclosure. (All of the motors described within this specification are typically electric motors, but any type of motor, such as hydraulic motors, may be used. Thus, this reference refers to all motors further discussed within this specification.) The screw conveyor breaks larger agglomerations and clumps of the oil sands into smaller pieces, further conditioning and exposing the oil sand to the solvent, such as water and/or the heavy distillate introduced at the sprayer 325. While the slurry chamber depicted illustrates a screw conveyor 330, one having skill in the art understands that other known methods of conditioning and transporting slurries of oil sands and distillates can be used.

The partially conditioned slurry optionally is delivered to the dissolution chamber 35. FIG. 3 illustrates this at line 30, but it is understood that line 30 represents a physical connection between the slurry chamber 25 and the dissolution chamber 35, such as a pipeline, open chute, or other physical connections known. It is also understood that the connection between the slurry chamber 25 and the dissolution chamber 35 typically is air tight or nearly air tight, which means that outside air is prevented or limited from entering into the processing system 10 and vapors, solvents and other volatiles are prevented or limited from escaping from the processing system 10.

Figure 4:
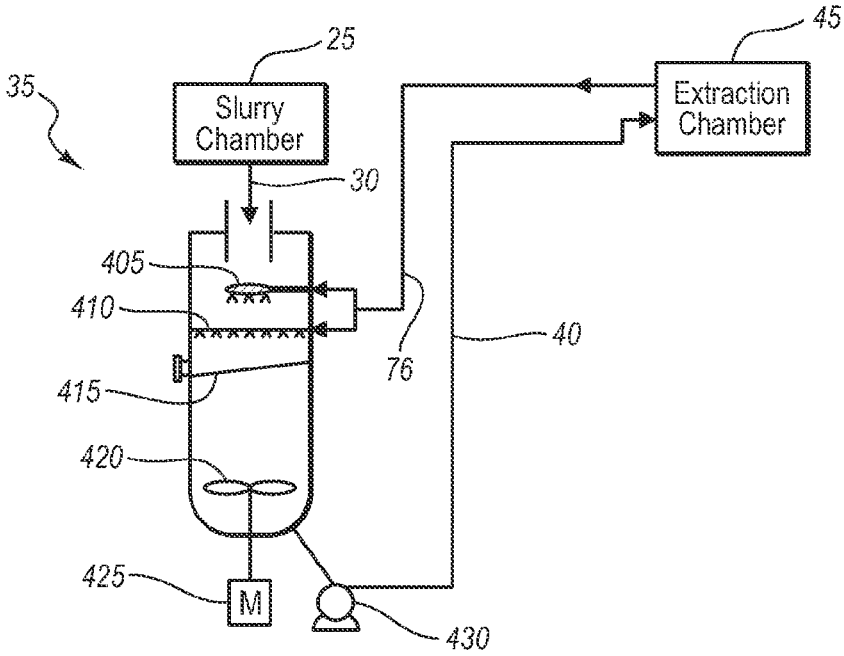
FIG. 4 depicts an embodiment of a dissolution chamber used in an embodiment of the system.

An embodiment of the dissolution chamber 35 is illustrated in FIG. 4. The slurry of oil sands and solvent, such as water or heavy distillate, is delivered from the slurry chamber 25 via line 30, as discussed above. The slurry is further treated with a second solvent delivered into the dissolution chamber 35 via third sprayer 405 and fourth sprayer 410. While FIG. 4 illustrates sprayers 405 and 410, it is understood that either fewer or more sprayers can be used. The solvent can be water, either hot or cold and/or with a mixture of various chemical additives or treatments included, a mixture of bitumen and heavy solvent, referred to as "bitumen oil", or other hydrocarbon based solvent, that is optionally delivered via line 76 from the extraction chamber, or vessel, 45. While a ratio of bitumen to solvent typically ranges from 60/40 to 40/60, it is understood that the solvent can range from entirely bitumen to entirely solvent.

The slurry with additional solvent descends under gravity in the dissolution chamber 35 through an optional screen, or screens, 415. While any type of screen 415 can be used, the embodiment depicted uses a trough-type screen. The size (mesh) of the screen is selected to vary with the size and condition of the oil sands and is configured to further reduce any agglomerations or clumps of oil sands into yet smaller pieces, thereby further exposing all or nearly all parts of the oil sands to the solvents that act to remove the bitumen from the oil sands. The screens can be configured such that the uppermost screen has the largest spaces (or least fine mesh, i.e., has a small mesh number) such that larger agglomerations are broken up slightly. Additional screens, if used, might have a successively larger mesh number (i.e., it is a finer mesh allowing only small agglomerations to pass) such that the size of the agglomerations and clumps of oil sands become progressively smaller as they descend in the dissolution chamber 35. This ensures that the oil sands become further exposed to the solvent and thereby conditioned to increase the amount of bitumen removed from the oil sands. The screens are configured to be removed and replaced as needed for maintenance.

Once the slurry passes through the screen 415, it descends under the influence of gravity towards the bottom of the dissolution chamber 45. An optional agitator 420 is operably connected and configured to rotate under the motive power provided by a motor 425. The agitator 420 further conditions and mixes the slurry to ensure that the oil sands in the slurry are well mixed with the solvent, thereby creating in large measure froth of bitumen with solvent.

The dissolution chamber 35 typically operates at or within several pounds of atmospheric pressure. The time during which the slurry within the dissolution chamber 35 is conditioned is optimized to maximize the amount of bitumen produced against the cost of operating the processing system 10. In addition, the interior temperature at which the dissolution chamber 35 operates is also optimized to maximize the amount of bitumen produced against the cost of operating the processing system 10.

The conditioned slurry and froth is drawn off from near the bottom of the dissolution chamber 35 via line 428. Pump 430 urges the slurry through line 40 to the extraction chamber, or vessel, 45. The pump 430 can be of any type of pump configured to pump slurries and other dense fluids, including duplex, triplex and other types piston-style pumps, centrifugal pumps, and others known to one having skill in the art.

Figure 5A:
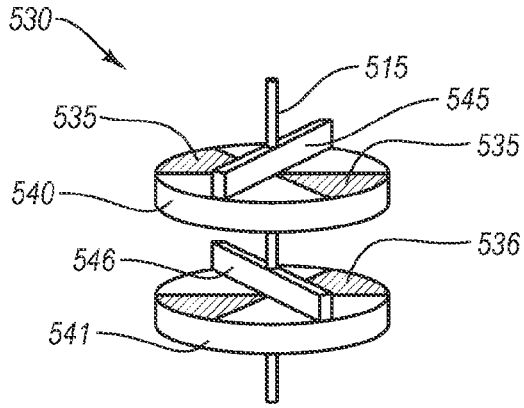
FIG. 5A depicts an embodiment of plurality of trays and scrapers used in an embodiment of the extraction chamber depicted in FIG. 5.
Figure 5:
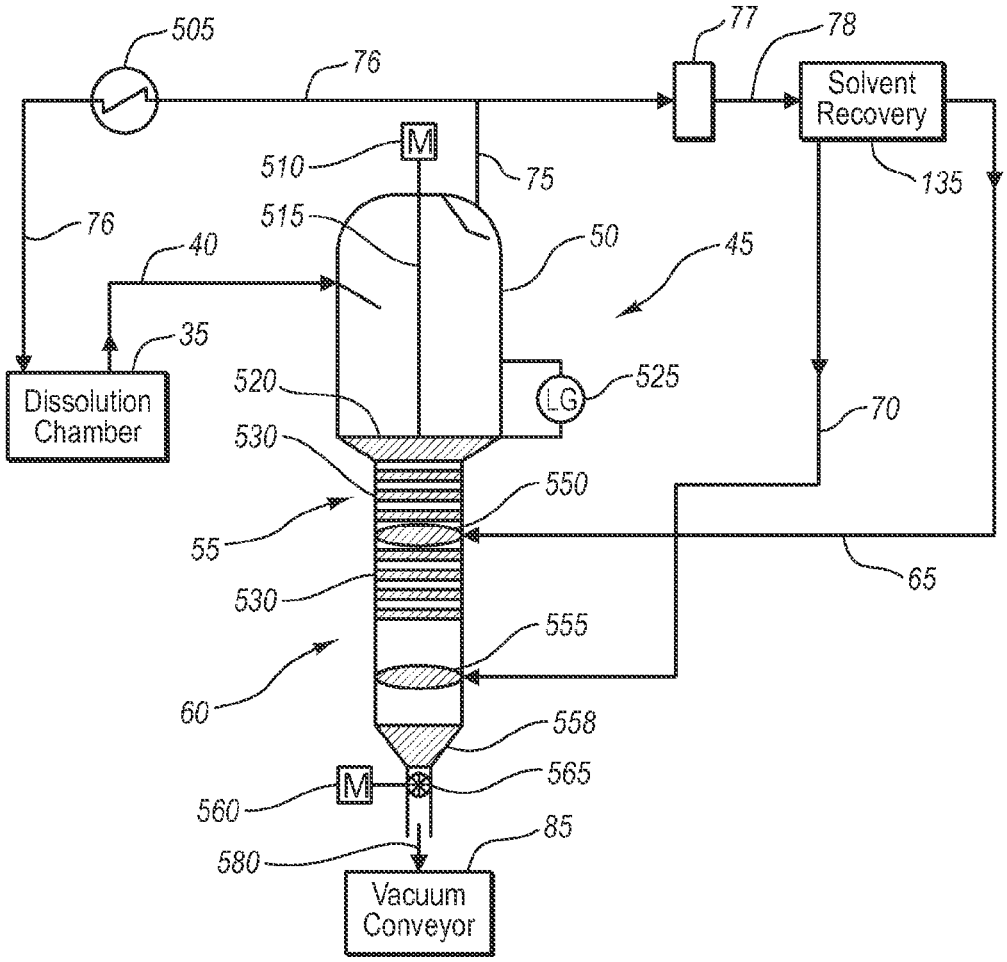
FIG. 5 depicts an embodiment of an extraction chamber used in an embodiment of the system.

The slurry and froth delivered from the dissolution chamber 35 to the extraction chamber, or vessel, 45 arrives via line 40 typically, although not necessarily, near an upper third portion of the extraction chamber, or vessel, 45, as illustrated in FIG. 5. This upper third portion of the extraction chamber, or vessel, 45 is referred to as the settling section 50 for convenience. While the settling section 50 is referred to as part of the upper third of the extraction chamber, or vessel, 45, it is understood that the boundary between the settling section 50 and the first extraction/rinsing section 55 and the second extraction/rinsing section 60 is one more of function than a precise geographical landmark of the extraction chamber, or vessel, 45 and is defined as such for convenience.

Typically, the slurry enters into the settling section 50 through a port connected with line or conduit 40 with an angular momentum relative to a center line (one that follows the shaft 515, which is discussed in further detail below). In other words, the port is typically, although not necessarily, configured to enter the settling section 50 at an angle to impart the slurry with an angular momentum. The angular momentum of the slurry propels the heavier sands and other sediments towards the outer portion (i.e., furthest from the center line along shaft 515), while the lighter fluids remain closer to the center line, helping to separate the bitumen and fluids from the sands.

The sands, some of which still having bitumen adhered thereto, and other sediments descend under the influence of gravity in the settling section 50, and settle, to a degree, as depicted at 520. These bitumen and solvent-wetted sands 520 settle into the first extraction/rinsing section 55.

The first extraction/rinsing section 55 is configured to further condition the oil sands and expose any sands with bitumen remaining thereon to additional solvent, typically a heavy solvent, although water may be used, to remove any remaining bitumen and dilute the froth. The first reaction/rinsing section 55 includes one or more tray-scrapers 530, as seen in FIG. 5 and enlarged in FIG. 5A. The oil sands fall under the influence of gravity onto a tray 540. The tray 540 includes one or more openings 535 within the tray through which the oil sands can pass under the influence of gravity to another tray 541 or towards the bottom of the extraction chamber, or vessel, 45. The tray 541 also includes openings 536, but the openings 536 of the another tray 541 are offset from the openings 535 of tray 540. Offsetting the openings 535 and 536 aids in conditioning the oil sands because it prevents oil sands from descending through any openings that could otherwise be aligned and thus allow some oil sands to descend to the bottom of the extraction chamber, or vessel, 45 without encountering a tray 540 or 541.

Associated with tray 540 is a scraper 545 and with tray 541 is scraper 546. The scrapers 545 and 546 rotate relative to the respective tray to which it is associated. That is, the tray 540, 541 may rotate relative to a fixed scraper 545, 546; the scraper 545, 546 may rotate relative to the fixed tray 540, 541; or, both the tray 540,541 and the scraper 545, 546 both rotate relative to each other. Regardless, a shaft 515 operably connected to a motor 510 is configured to impart the rotation to the tray 540, 541, the scraper 545, 546, or both.

The openings 535, 536 of the trays 540, 541 are illustrated to be 90° segments of the round tray 540, 541 with each opening 180° apart on a selected tray, as illustrated in FIG. 5A. The opening 536 of tray 541 is also offset by 90° from the opening 535 in the tray 540 that lies above. One having skill in the art would understand that the size of the opening can be adjusted from 90° to larger or smaller opening as desired. In addition, the size of the opening 536 can be adjusted to be different from that of opening 535. For example, opening 535 can be adjusted to 110° while opening 536 remains at 90°. In addition, the number of openings in each tray can be adjusted to include more or fewer openings, and the number of openings between trays can also vary. Finally, the degree of offset between the openings of successive trays can be adjusted as desired.

FIG. 5 illustrates that the first extraction/rinsing section 50 includes three tray-scrapers 530, but one having skill in the art understands that either more or fewer tray scrapers 530 can be used.

The first extraction/rinsing section 50 includes a sprayer or sparger 550 that injects a solvent, typically a heavy solvent such as an aromatic (i.e., having a chemical formula that includes a benzene ring) typically, although not necessarily, below the first series of tray-scrapers 530. The heavy solvent typically arrives via line 65 from the solvent recovery system 135, although provision for injecting new (i.e., unrecovered) solvent can be made. The solvent acts on any bitumen remaining on the oil sands as the oil sands are conditioned as it moves through the tray-scrapers 530 and dilutes the bitumen in the froth. This arrangement further removes any bitumen remaining on the sands. The heavy solvent typically removes the bitumen while minimizing the amount of any asphaltene present in the bitumen from precipitating out of solution. The less dense bitumen (as compared to the sands and any sediment) and any heavy solvent that does not adhere to the sands ascend towards the top of the extraction chamber, or vessel, 45. Thus, the sands towards the bottom of the first extraction/rinsing section 50 are substantially free of bitumen. Instead, the sands at the bottom of the first extraction/rinsing section 50 is therefore substantially wetted with heavy solvent, or heavy solvent-wetted sands.

The heavy solvent-wetted sands descend under the influence of gravity to the second extraction/rinsing section 60 of the extraction chamber, or vessel, 45. The heavy solvent-wetted sands descends through one or more tray-scrapers 530 similar to those described in detail above in the first extraction/rinsing section 55. In the second extraction/rinsing section 60, light solvent, typically a paraffinic (i.e., a hydrocarbon solvent whose chemical formula includes a single bond chain of carbon to which hydrogen bonds) with a lower distillation point than the heavy solvent (i.e., the paraffinic vaporizes at a lower temperature) is injected into the second extraction/rinsing section 60 via sprayer or sparger 555 typically positioned below the heavy solvent sprayer or sparger 550. The light solvent typically is delivered to the sprayer 555 via line 70 from the solvent recovery system 135, although provision can be made for injecting new light solvent into the second extraction/rinsing section 60.

As the light solvent rises in the second extraction/rinsing section 60, it interacts with the heavy solvent-wetted sands, as aided through the mechanical agitation of the heavy solvent-wetted sands with the tray-scrapers 530 in the second extraction/rinsing section 60. The light solvent, typically hexane, although other, similar solvents can be used, removes most, if not all, of any bitumen that remains adhered to the sands. The light solvent has a greater likelihood of causing any asphaltene present in the bitumen to precipitate out of solution, which could cause problems such as clogging with the processing system 10. Thus, it is preferred to inject the light solvent after the heavy solvent has removed the majority of the bitumen from the oil sands. In addition, the light solvent displaces the heavy solvent adhered to the heavy solvent-wetted sands. Thus, after treatment in the second extraction/rinsing section 60 the sands have light solvent adhered thereto to form light solvent-wetted sands 558. The light solvent, having a higher vapor pressure (or lower distillation point) than the heavy solvent, is easier to remove from the sands during subsequent processing, as will be discussed below.

The removed heavy solvent rises towards the top of the extraction chamber, or vessel, 45 for removal as will be discussed below. The now light solvent-wetted sands 558 descend under the influence of gravity towards the bottom of the extraction chamber, or vessel, 45. The light solvent-wetted sands are depicted at 558 in FIG. 5.

The extraction chamber, or vessel, 45 typically operates at an elevated temperature as compared to ambient temperature. The elevated temperature, typically in the range of about 20° C. to about 100° C. and, more preferably, about 40° C. to about 80° C., and more preferably still, about 50° C. to about 70° C., improves the ability of the heavy and light solvents to remove the bitumen from the oil sands. In addition, the extraction chamber typically operates at an elevated internal pressure relative to ambient (i.e., 1 atmosphere, or 14.7 pounds per square inch). This is done to prevent the light solvent, which has a relatively lower distillation point than the heavy solvent, from vaporizing within the extraction chamber, or vessel, 45. In other words, the elevated pressure within the extraction chamber, or vessel, 45 keeps the light solvent in a substantially liquid phase. Typically, the pressure within the extraction chamber, or vessel, 45 is in a range of about 1 ½ to about 5 times ambient pressure and, more preferably, about 2 to about 4 times ambient pressure, although other pressures can be used.

The light solvent-wetted sands 558 exits the extraction chamber, or vessel, 45 via a valve 565 typically proximate the bottom of the extraction chamber, or vessel, 45 that is operably connected to and configured to be powered by a motor 560. The valve 565 in the embodiment depicted in FIG. 5 is a rotary-valve type, although valves of other types can be used.

The light solvent-wetted sands 558 are delivered via line 80 to the vacuum conveyor 85. Line 80, as is understood, is a figurative representation of the connection between the extraction chamber, or vessel, 45 and the vacuum conveyor 85. The connection between the extraction chamber, or vessel, 45 and the vacuum conveyor 85 optionally is substantially air tight to prevent outside air from entering (or to minimize the amount of air entering) into the processing system 10 and to prevent or minimize the amount of any volatile hydrocarbons, solvents, vapors, or other potentially harmful pollutants from escaping the system.

At the top of the extraction chamber, or vessel, 45, the froth of bitumen released from the oil sands and any solvent, primarily heavy solvent released from the heavy solvent-wetted sands through the action of the light solvent, is drawn off via line or conduit 75 typically, although not necessarily, positioned proximate a top of the extraction chamber, or vessel, 45. A valve (not shown) can be used to connect the extraction chamber, or vessel, 45 to the line 75, as known in the art. The bitumen and solvent (typically bitumen oil, as discussed above) is sent via line 76 through a heat exchanger 505 to the dissolution chamber 35 as discussed above. In addition, line 76 delivers bitumen oil to the filter 77, which is configured to remove fine particulates and sediment entrained with the froth of bitumen and solvent drawn off from the extraction chamber, or vessel, 45. After passing through the filter 77, the froth of bitumen and solvent is delivered via line 78 to the solvent recovery system 135, which is configured to separate the bitumen from the solvent as will be discussed below.

Figure 9:
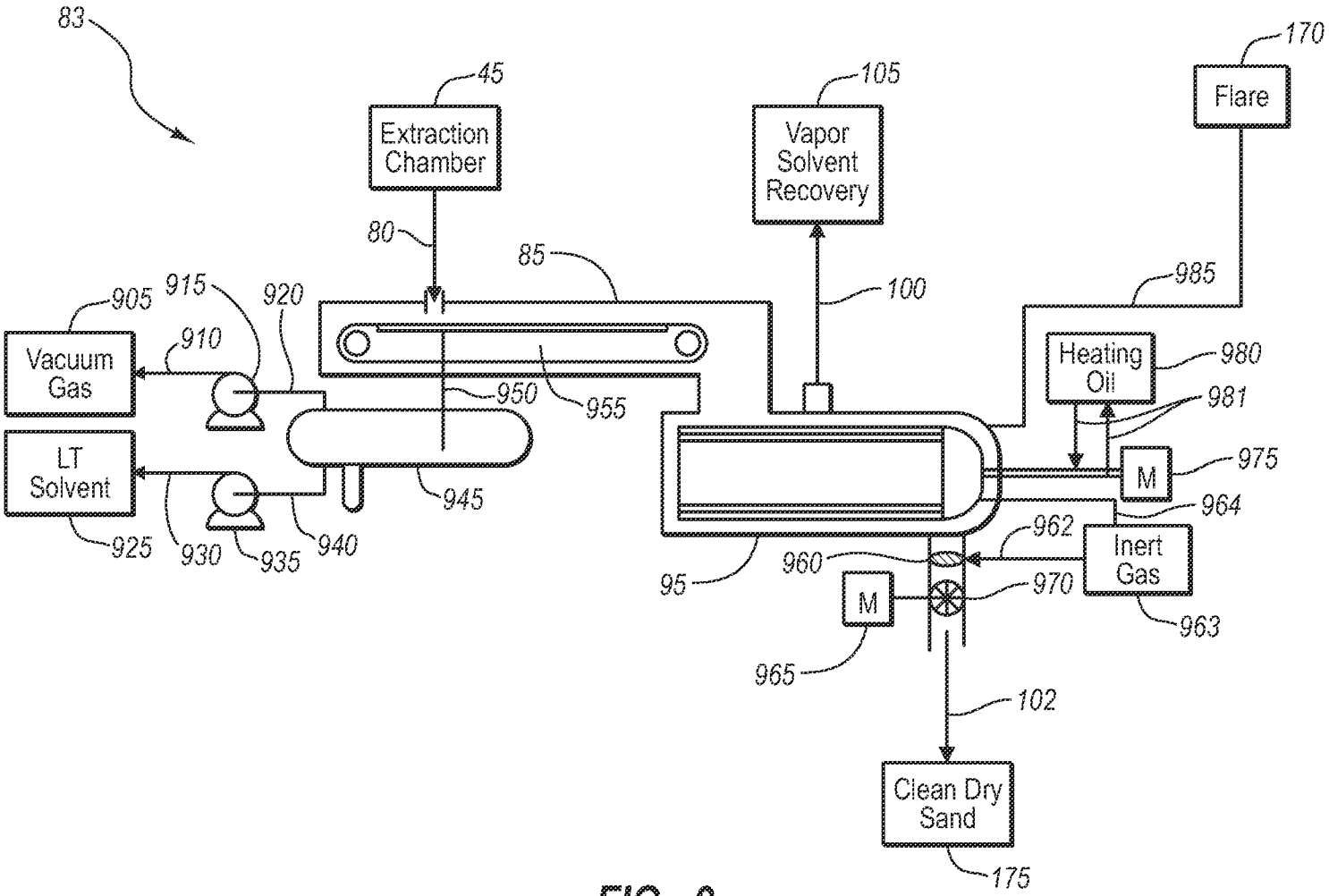
FIG. 9 depicts an embodiment of a vacuum conveyor and a dryer used in an embodiment of the system.

The light solvent-wetted sand 558 optionally arrives from the extraction chamber, or vessel, 45 into the vacuum conveyor 85 via line 80, as illustrated in FIG. 9, upon which the light solvent-wetted sands 558 is deposited upon the conveyor 955. The conveyor 955 includes the normal items necessary for a conveyor as known in the art.

An optional vacuum system 945 creates a vacuum in the vacuum conveyor 85 via line 950, drawing off a portion of the light solvent from the light solvent-wetted sands. Pump 935 draws off the light solvent via line 940, sending the light solvent 925 via line 930 to be recycled and reused in the processing system 10. Pump 915 draws the vacuum gas 905 via line 920 and sends the vacuum gas via line 910 to the vapor recovery solvent system 105.

The conveyor 955 transports and deposits the remaining light solvent-wetted sands into a rotary dryer 95. A source of hot heating oil 980 optionally jackets the rotary dryer 95 to provide heat to the rotary dryer 95. The heating oil 980 can be from an outside source or can be hot liquids from other parts of the processing system 10 routed to the rotary dryer 95. The temperature of the heating oil is typically in the range of 200° to 250° C., although other temperatures fall within the scope of the disclosure.

The rotary dryer 95 further applies heat to the light solvent-wetted sands and rotates the sands within, typically around several fins or paddles to ensure even drying. As the light solvent is vaporized (and circulating inert gas entrained therein; the source of the inert gas is discussed below), it is drawn off from the rotary dryer 95 via line 100 and sent to the vapor solvent recovery system 105.

The rotary dryer 95 is configured such that as the light solvent is vaporized from the light solvent-wetted sands, the dry sands move towards a valve 970 from which the substantially clean, dry sands exits the rotary dryer 95. The valve 970 may be of any type known in the art, but in this particular embodiment it is a rotary valve operably coupled to a motor 965 that provides the motive force to turn the rotary valve 970. Above the rotary valve 970, a source of inert gas 963 optionally supplies inert gas via line 962 to sprayer or sparger 960. Optionally, inert gas is also injected directly into the rotary dryer 95 via line 964. The inert gas is typically nitrogen, carbon dioxide, a mixture thereof, and other types of inert gas fall within the scope of the embodiment. The inert gas strips any light solvent that remains adhered to the sands and purges any vaporized light solvent from the area of the rotary valve 970, minimizing or preventing any light solvent from escaping the rotary dryer 95 and, thereby, reducing cost and minimizing air pollution.

Any excess inert gas injected into the rotary dryer 95 is optionally drawn off from the rotary dryer 95 via line 985 and flared to ambient, or outside, air.

The clean dry sands pass through the rotary valve 970 and can be stored at 175 for later use as backfill in the oil sands mining pit, as a proppant in fracturing fluids used in the petroleum exploration industry, as construction sands, and other uses. Before reaching the clean sands storage 175, the hot sands that exits the rotary dryer 95 optionally passes through a heat exchanger (not shown) through which the heat from the hot sands is captured to heat fluids and the like that are used in the processing system 10, thereby increasing the energy efficiency of the system 10 as a whole.

Figure 7:
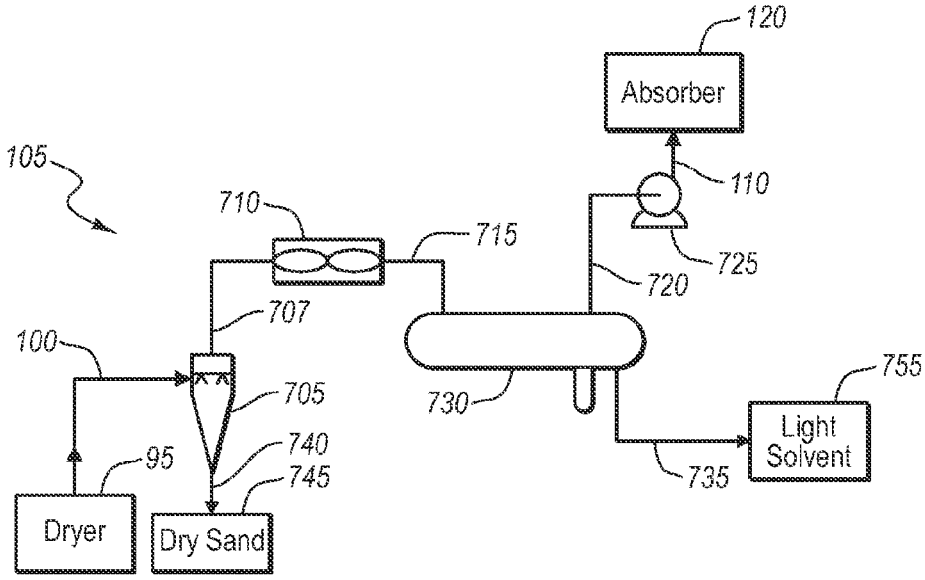
FIG. 7 depicts an embodiment of a vapor solvent recovery system used in an embodiment of the system.

An embodiment of a vapor solvent recovery system 105 is depicted in FIG. 7. Vaporized light solvent (and any circulating inert gas) arrives from the dryer 95 via line 100, optionally passing through a cyclonic separator 705. The cyclonic separator 705 is configured to remove sand that is entrained with the vaporized light solvent drawn off from the rotary dryer 95. The cyclonic separator 705 delivers dry sands 745 via line 740. The vaporized light solvent travels via line 707 through a cooler 710, which reduces the heat of the vaporized solvent. A receiver 730 draws the vaporized solvent via line 715, sending condensed, liquid, light solvent 755 via line 735 for reuse. Still vaporized light solvent (and any circulating inert gas) is sent from the receiver 730 through line 720 to a blower 725. The blower 725 urges the vaporized light solvent via line 110 to the absorber system 120.

Figure 6:
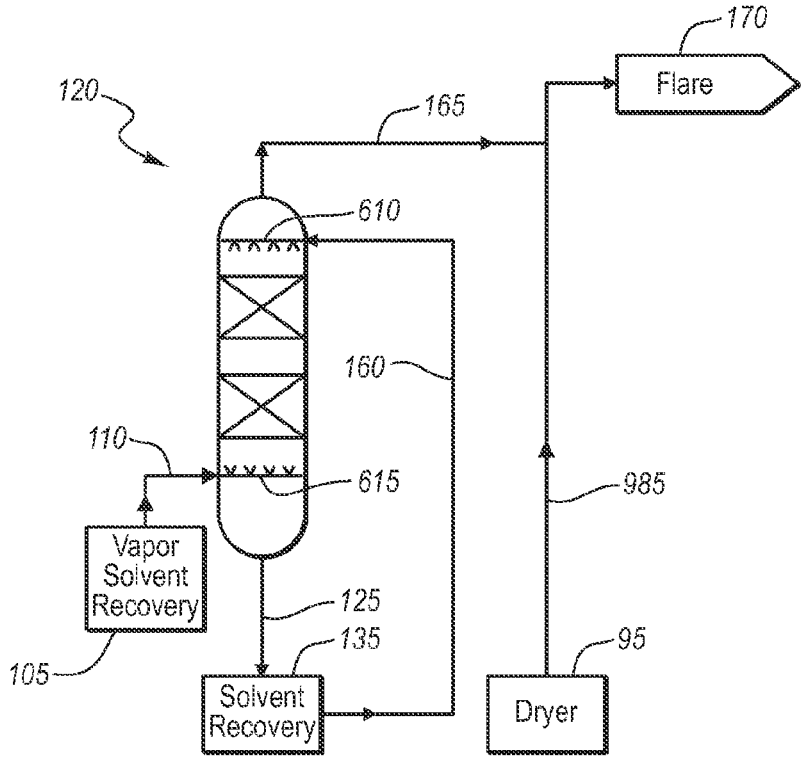
FIG. 6 depicts an embodiment of an absorber system used in an embodiment of the system.

An embodiment of an absorber system 120 is depicted in FIG. 6 in which vaporized light solvent (and any circulating inert gas) arrives from the vapor solvent recovery system 105. The vaporized light solvent is injected into the absorber system 120 via a sprayer or sparger 615. A heavy distillate, such as diesel, is injected via 610 at the top of the absorber system 120. The heavy distillate typically arrives via line 160 from the solvent recovery system 135. Optionally, the heavy distillate arrives via another source of heavy distillate (not shown). The heavy distillate strips the vaporized light solvent from the stream, and the heavy distillate and absorbed light vapor solvent are sent via line 125 to the solvent recovery system 135. Any inert gas that remains is flared 170 to the atmosphere via line 165, as is any inert gas sent via line 985 from the rotary dryer 95.

Figure 8:
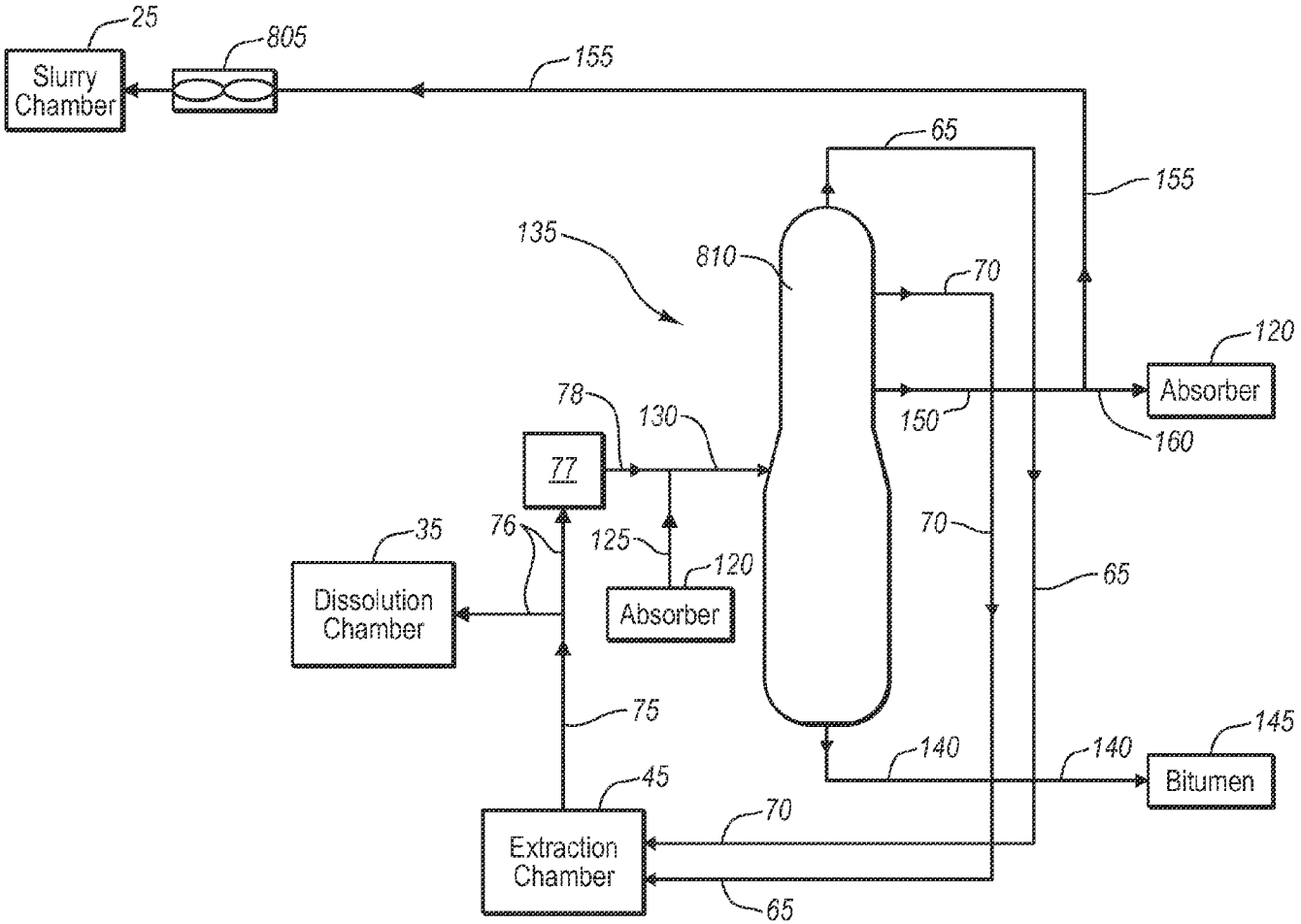
FIG. 8 depicts an embodiment of a solvent recovery system used in an embodiment of the system.

An embodiment of a solvent recovery system 135 is depicted in FIG. 8. The solvent recovery system 135 includes distillation column 810. The distillation column 810 is of a type known in the art and typically includes two or more trays. Bitumen and heavy solvent arrives to the distillation column 810 via line 130. Heavy distillates are drawn off from the distillation column 810 via line 150, which are then optionally sent via line 160 to the absorber system 120 and via line 155 to the slurry chamber 25 after passing through a cooler 805.

Heavy solvents are drawn off from the distillation column 810 via line 70 and optionally sent to the extraction chamber, or vessel, 45 via line 70.

Light solvents are drawn from the top of the distillation column 810 via line 65 and optionally sent to the extraction chamber, or vessel, 45.

Separated bitumen oil is separated from near the bottom of the distillation column 810 and sent via line 140 to bitumen storage 145.

EXAMPLE 1

An example of an embodiment of the processing system 10 is depicted in FIGS. 10 through 14; Table 1 provides information as to the temperature, pressure, and composition of various streams of material throughout the processing system 10 and provides context for such terms as substantially, about, proximate, and other terms of degree. The identical figure numbers in FIGS. 10 through 14 denote the same element as those figure numbers in FIGS. 1 through 9, for which a more detailed explanation can be found above.

Figure 10:
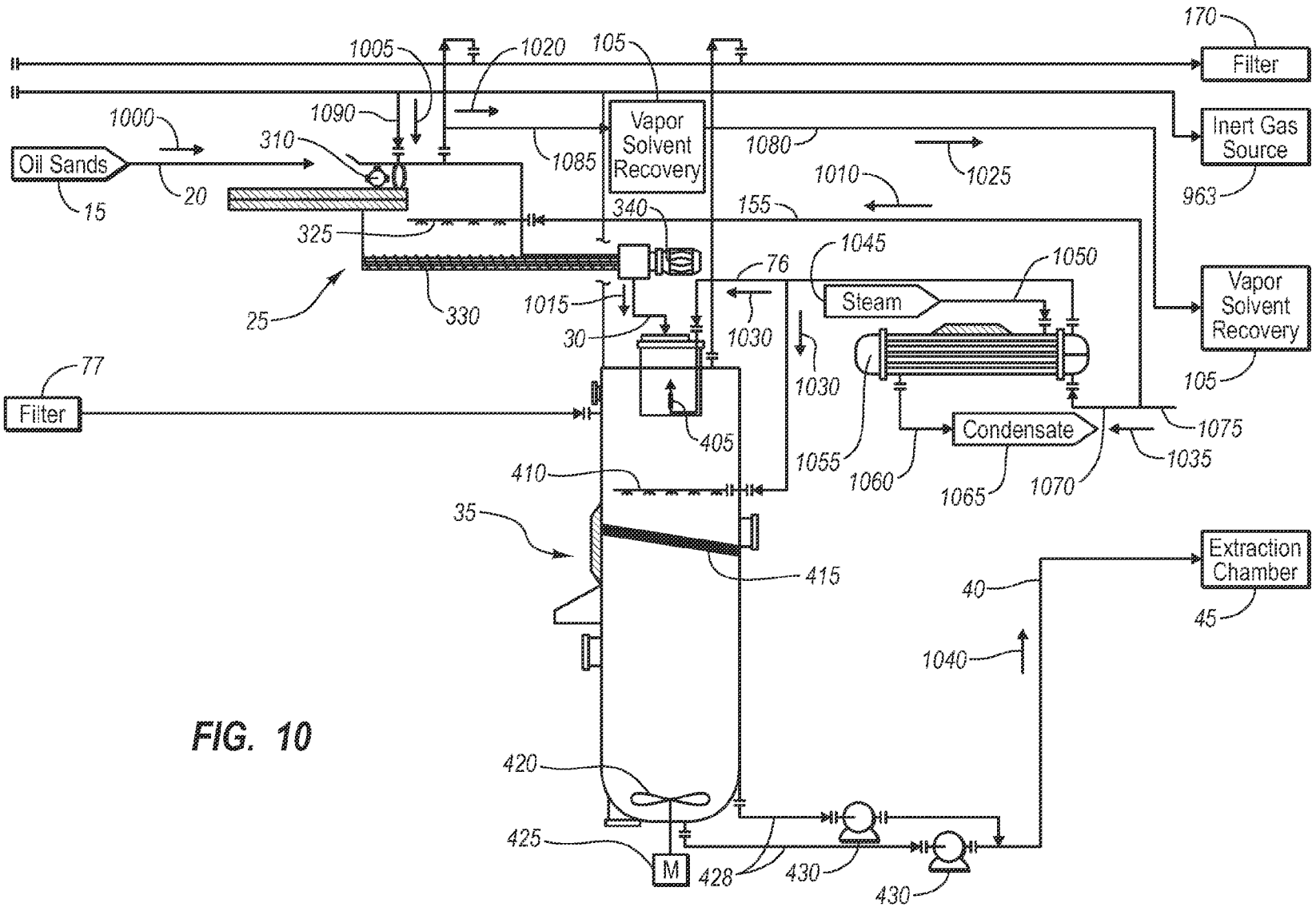
FIG. 10 an embodiment of a slurry chamber and a dissolution chamber used in an example of the system.

A slurry chamber 25 and dissolution chamber 35 are depicted in FIG. 10. Oil sands 15 are mined and delivered via line 20 to the slurry chamber as stream 1000. The stream 1000 enters into the slurry chamber 25 via feeder-breaker 310. An inert gas stream 1005, in this instance carbon dioxide and nitrogen, is delivered via line 1090 to a sprayer or sparger 320.

The inert gas prevents or minimizes the amount of external air entering into the processing system 10.

A stream 1010 of bitumen oil, a mixture of bitumen and solvent, typically a heavy distillate such as diesel that has a high vapor pressure, arrives to the slurry chamber 25 via line 155 and is injected into the slurry chamber 25 via sprayer 325. (As discussed above, water and/or other solvents may be used, but this example discusses the use of bitumen oil as the solvent.) The bitumen oil mixes with the oil sands to form a slurry stream 1015 that the screw conveyor 330 conditions as it transports the slurry 1015 to the dissolution chamber 35.

Excess nitrogen and any solvent that vaporizes in the slurry chamber 25 is drawn off as stream 1020 from the slurry chamber 25 via line 1085 and sent to the vapor solvent recovery system 105.

Line 30 delivers the slurry stream 1015 to the dissolution chamber 35. The slurry stream 1015 is exposed to stream 1030 of bitumen oil, a mixture of bitumen and solvent, sent via line 76 through sprayer 405. Line 76 also delivers stream 1030 of bitumen oil to sprayer 410 within the dissolution chamber 35. The stream 1030 is heated through a steam heat exchanger 1055 that has hot steam 1045 enter the heat exchanger 1055 via line 1050 and condensate 1065 leave the heat exchanger 1055 via line 1060. The cooler stream 1035 of bitumen oil enters the heat exchanger 1055 via line 1070.

Vaporized solvent in stream 1025 is drawn off proximate the top of the dissolution chamber 35 via line 1080 and sent to the vapor solvent recovery system 105.

The slurry within the dissolution chamber 35 passes through one or more screens 415 to reduce the size of the solids entrained within the slurry. The screen 415 in this embodiment is a trough-type screen, although other types of screens are contemplated.

An agitator 420 operably connected to motor 425 is configured to condition the slurry to provide a relatively homogenous slurry in terms of particle size of the solids and the degree to which the oil sands are exposed to the solvent in the slurry.

The slurry is drawn from proximate the bottom of the slurry chamber. In the embodiment depicted in FIG. 10, two separate lines 428 draw off the slurry and pumps 430 urges the slurry as stream 1040 towards the extraction chamber, or vessel, 45 via line 40.

Figure 11:
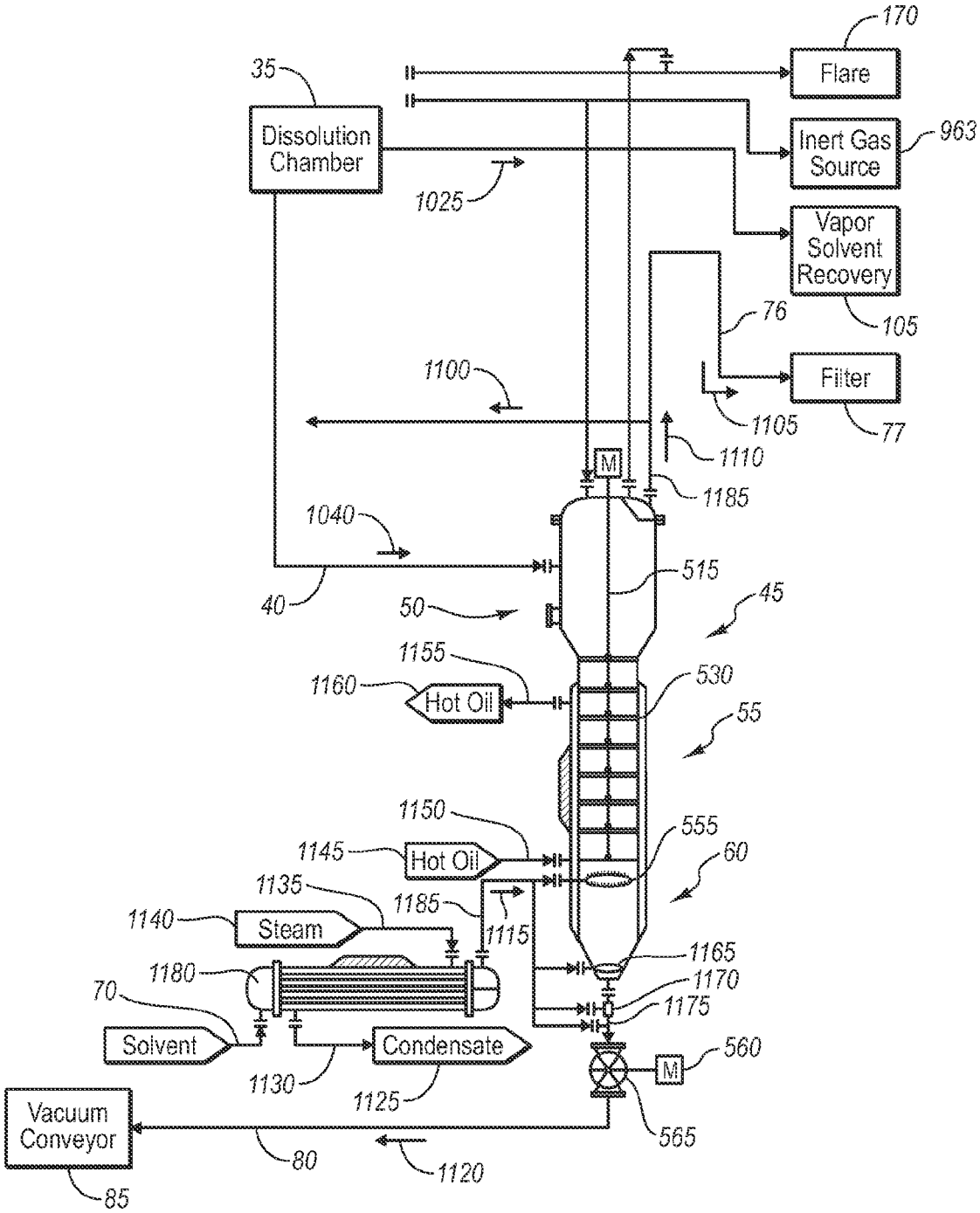
FIG. 11 an embodiment of an extraction chamber used in an example of the system.

Another embodiment of an extraction chamber, or vessel, 45 is depicted in FIG. 11. The slurry stream 1040 from the dissolution chamber 35 enters the upper portion of the extraction chamber, or vessel, 45 in the settling section 50. The slurry stream descends under the influence of gravity downward in the settling section to the first extraction/rinsing section 55. In this particular embodiment, the extraction chamber, or vessel, 45 has a plurality of trays-scrapers 530 in only the first extraction/rinsing section 55, unlike the embodiment discussed above which also has trays-scrapers 530 in a second extraction/rinsing section 60. The slurry encounters the plurality of tray-scrapers 530 similar to those described above in FIGS. 5 and 5A. The plurality of tray-scrapers 530 are operably connected shaft 515 which in turn is operably connected to motor 510, which urges the tray-scrapers 530 to rotate as described above.

Solvent stream 1115 enters the second extraction/rinsing section 60 via sprayer 555 and line 1185 proximate the lower third of the extraction chamber, or vessel, 45. Solvent arrives via line 70 and passes through a heat exchanger 1180 to heat the solvent stream. Steam 1140 enters into the heat exchanger via line 1135 and exits as condensate 1125 via line 1130.

Solvent stream 1115 also enters via sprayer 1165 and, optionally, at valves 1170 and 1 175. The solvent stream 1115 that enters via sprayer 1165 and valves 1170 and 1175 add additional solvent, if necessary to the light solvent-wetted sands to ensure that the sands flow sufficiently easy through the rotary valve 565 into line 80 (as stream 1120) going to the vacuum conveyor 85.

Hot oil 1145 is sent via line 1150 to jacket the extraction chamber, or vessel, 45 to elevate the temperature within the extraction chamber, or vessel, 45. The cooled oil 1160 leaves via line 1155. Operating the extraction chamber at an elevated temperature improves the efficiency with which the bitumen is removed from the oil sands, as discussed above.

TABLE 1

Stream Composition, Temperature, and Pressure

| Stream Fluid No. | Fluid Name | Fluid State | Temp ° C. | Press ATM (kg/cm$^2$) | Sand (kg/hr) | Bitumen (kg/hr) | Solvent (kg/hr) | $CO_2$ (kg/hr) | $O_2$ (kg/hr) | $N_2$ (kg/hr) | $H_2O$ (kg/hr) |
|---|---|---|---|---|---|---|---|---|---|---|---|
| 1000 | Sands | Sands | 20 | ATM | 37,648 | 3,219 | — | — | — | — | 800 |
| 1015 | Slurry | Slurry | 60 | ATM | 37,648 | 6,438 | 1,812.7 | — | — | — | 800 |
| 1040 | Slurry | Slurry | 60 | 3 | 37,648 | 19,314 | 9,800.6 | — | — | — | 800 |
| 1110 | Bit. Oil | Liquid | 60 | 2 | — | 19,314 | 13,116 | — | — | — | — |
| 1100 | Bit. Oil | Liquid | 60 | 3 | — | 16,095 | 10,930 | — | — | — | — |
| 1105 | Bit. Oil | Liquid | 60 | 3 | — | 3,219 | 2,186 | — | — | — | — |
| 1030 | Bit. Oil | Liquid | 90 | 3 | — | 12,876 | 8,744 | — | — | — | — |
| 1250 | $H_2O$ | Liquid | 38 | 390 mm Hg | — | — | ~0 | 1 | ~0 | 0.3 | 769.8 |
| 1005 | $CO_2$ & $N_2$ | Vapor | 90 | 760 mm Hg | — | — | — | 27.6 | 1.7 | 80.4 | — |
| 1115 | Sol. | Liquid | 60 | 3 | — | — | 9,515.4 | — | — | — | — |
| 1120 | Sands & Sol | Slurry | 60 | 780 mm Hg | 37,648 | — | 6,200 | — | — | — | 800 |
| 1240 | $H_2O$ and Sol. | Liquid & Vapor | 38 | 400 mm Hg | — | — | 3,668.9 | 93.1 | 7.2 | 341.7 | 800.1 |
| 1200 | Sands & Sol. | Slurry & Liquid | 60 | 775 mm Hg | 37,648 | — | 2,629 | — | — | — | — |
| 1300 | $CO_2$ & Sol. | Vapor | 90 | 775.5 mm Hg | — | — | 257.3 | 243.1 | 19 | 898.7 | 0.2 |
| | $CO_2$ & Sol. | Vapor | 10 | 780 mm Hg | — | — | 22 | 20.8 | 1.6 | 76.8 | ~0 |
| 1245 | $CO_2$ & Sol. | Liquid | 38 | 390 mm Hg | — | — | 3,067.5 | 0.9 | ~0 | 0.2 | 1.3 |
| 1205 | $N_2$ & | Vapor | 38 | 390 mm Hg | — | — | 601.4 | 91.2 | 7.2 | 341.1 | 29 |

TABLE 1-continued

Stream Composition, Temperature, and Pressure

| Stream Fluid No. | Fluid Name | Fluid State | Temp ° C. | Press ATM ($kg/cm^2$) | Sand (kg/hr) | Bitumen (kg/hr) | Solvent (kg/hr) | $CO_2$ (kg/hr) | $O_2$ (kg/hr) | $N_2$ (kg/hr) | $H_2O$ (kg/hr) |
|---|---|---|---|---|---|---|---|---|---|---|---|
| 1235 | Sol. $N_2$ & Sol. | Vapor | 75 | 760 mm Hg | — | — | 601.4 | 91.2 | 7.2 | 341.1 | 29 |
| 1305 | $N_2$ & Sol. | Vapor | 90 | 775 mm Hg | — | — | 2,885.4 | 245.2 | 19 | 897.5 | 0.2 |
| 1310 | Sands | Sands | | ATM | 37,648 | — | — | — | — | — | — |
| 1315 | $CO_2$ | Vapor | 90 | Including | — | — | — | | — | — | — |
| 1420 | $N_2$ & Sol. | Vapor | 82 | 755 mm Hg | — | — | 4,616.2 | 364 | 28 | 1,319 | 29.1 |
| 1430 | $N_2$ & Sol. | Vapor | 55 | 728.1 mm Hg | — | — | 4,616.2 | 364 | 28 | 1,319 | 29.1 |
| 1440 | $N_2$ & Sol. | Liquid & Vapor | 0 | 726.5 mm Hg | — | — | 4,616.2 | 364 | 28 | 1,319 | 29.1 |
| 1450 | $N_2$ & Sol. | Vapor | 4 | 726.5 mm Hg | — | — | 377.2 | 356.4 | 27.9 | 1,317.7 | 0.3 |
| 1400 | $N_2$ & Sol. | Vapor | 10 | 780 mm Hg | — | — | 257.3 | 243.1 | 19 | 898.7 | 0.2 |
| 1025 | Sol. | Vapor | 77 | 755 mm Hg | — | — | 756.1 | — | — | — | — |
| 1470 | Sol. | Liquid | 4 | 726.5 mm Hg | — | — | 4,239 | 7.4 | ~0 | 1.3 | 1.2 |
| 1485 | $H_2O$ | Liquid | 4 | 726.5 mm Hg | — | — | ~0 | 0.2 | ~0 | ~0 | 27.6 |
| 1020 | $N_2$ & Sol. | Liquid & Vapor | 50 | 755 mm Hg | — | — | 373.1 | 27.6 | 1.7 | 80.4 | |
| 1010 | Bit. Oil | Liquid | 60 | 3 | — | 3,219 | 2,186 | — | — | — | — |
| 1035 | Bit. Oil | Liquid | 60 | 3 | — | 12,876 | 8,744 | — | — | — | — |
| 1300 | $N_2$ & Sol. | Vapor | 90 | 775.5 mm Hg | — | — | 256.4 | 245.2 | 19 | 897.5 | 0.2 |
| 1275 | $CO_2$ & $N_2$ | Vapor | 10 | 760 mm Hg | — | — | 97.9 | 93.1 | 7.2 | 341.7 | 0.2 |
| 1275 | $CO_2$ & $N_2$ | Vapor | 10 | 780 mm Hg | — | — | 98 | 92.6 | 7.2 | 342.2 | ~0 |
| 1495 | Bit. Oil | | | | | | | | | | |

Bitumen and solvent is drawn off from proximate the top of the extraction chamber, or vessel, 45 in stream 1110 via line 1185. Line 1185 branches into line 1075, which sends stream 1100 towards the dissolution chamber 35. Line 1185 also branches into line 76, which sends stream 1105 to filter 77.

Figure 12:
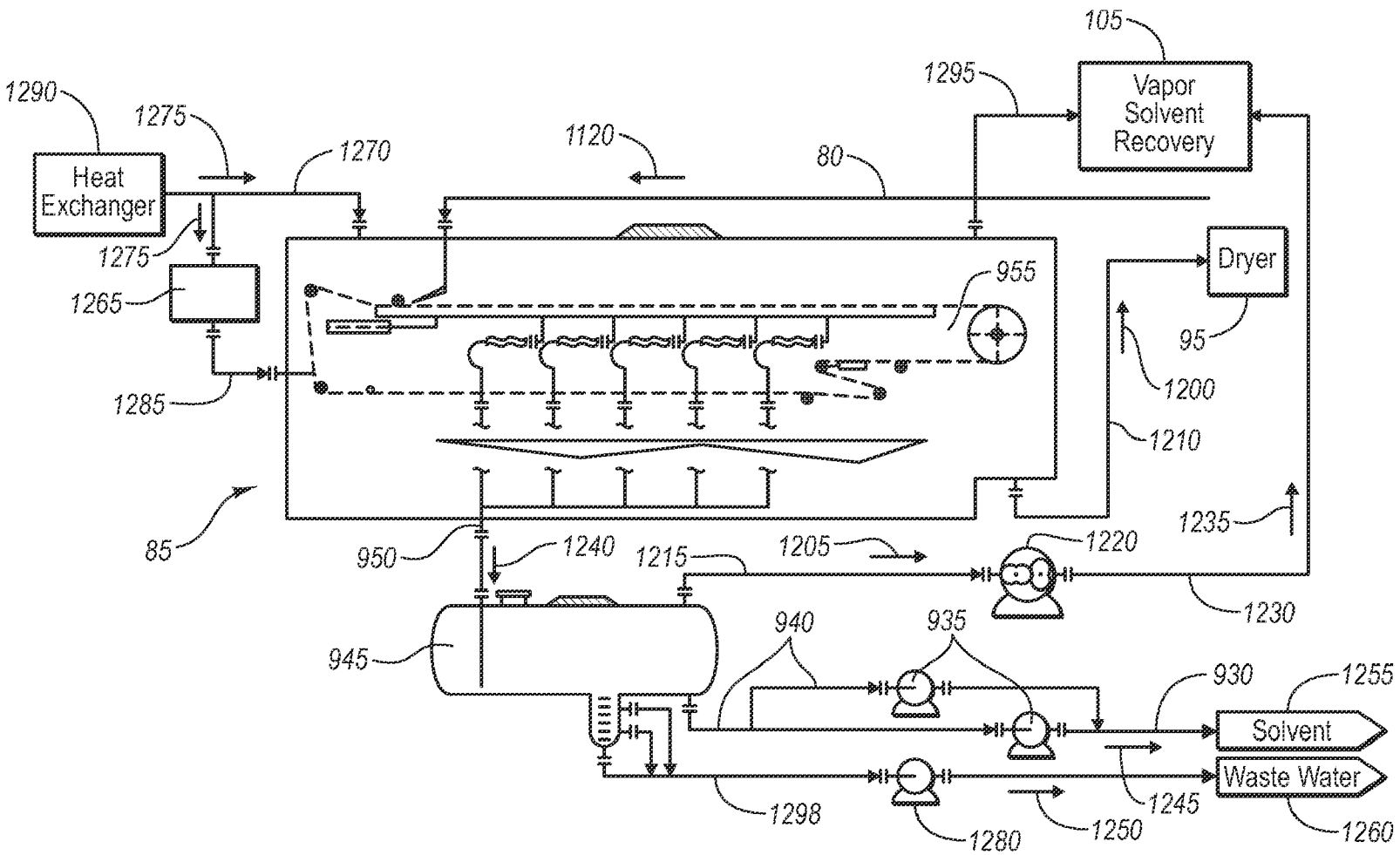
FIG. 12 an embodiment of a vacuum conveyor used in an example of the system.

An embodiment of a vacuum conveyor 85 is depicted in FIG. 12. Light solvent-wetted sands in stream 1120 are sent via line 80 to the vacuum conveyor 85. Stream 1120 is deposited upon conveyor 955. As discussed above, line 80 is configured to provide a substantially air tight connection between the extraction chamber, or vessel, 45 and the vacuum conveyor 85, by which it is meant that outside air is prevented (or the amount minimized) from entering into the vacuum conveyor 85 and vaporized solvent is prevented (or the amount minimized) from escaping the vacuum conveyor 85.

Inert gas, in this example carbon dioxide and nitrogen, in stream 1275 arrives via line 1270 from heat exchanger 1290 and is injected into the vacuum conveyor 85. A portion of stream 1275 passes through compressor 1265 and also enters vacuum conveyor 85 via line 1285. The inert gas stream 1275 further prevents the entrance of any outside air from entering into the vacuum conveyor 85.

Vacuum drum 945 draws off any water and solvent in stream 1240 via line 950 from the light-solvent wetted sands in stream 1120.

Line 1215 carries stream 1205 of nitrogen and solvent to vacuum pump 1220. The vacuum pump 1220 urges stream 1235 via line 1230 to the vapor solvent recovery system 105.

Lines 940 carries stream 1245 of carbon dioxide and solvent to pumps 935, which urge stream 1245 via line 930 to a solvent storage 1255, for example, or optionally the solvent recovery system 135.

Line 1298 carries waste water stream 1250 away from vacuum drum 945 and to pump 1280, which urges stream 1250 to a waste water storage and treatment 1260 and for optional reuse in the process.

The remaining light solvent-wetted sands in stream 1200 are removed via line 1210 from conveyor 85 and sent to the rotary dryer 95.

Figure 13:
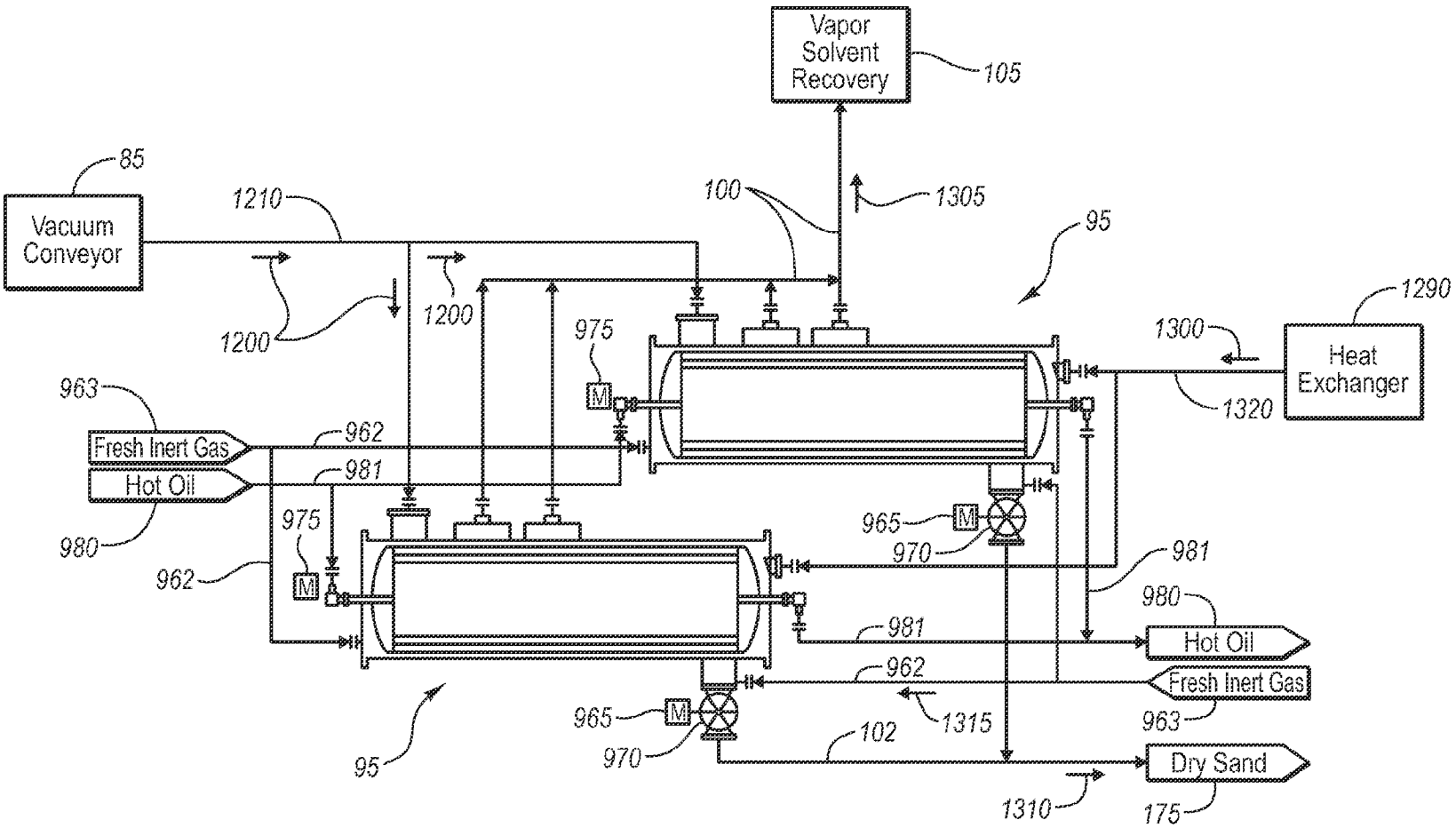
FIG. 13 an embodiment of a dryer used in an example of the system.

An embodiment of a rotary dryer 95 is depicted in FIG. 13. In this embodiment, two rotary dryers 95 are employed. Light solvent-wetted sands in stream 1200 are delivered from the vacuum conveyor 85 via line 1210 to the rotary dryers 95. As discussed previously, the connection between the rotary dryer 95 and the vacuum conveyor 85 are substantially air tight.

A source of fresh inert gas 963, such as carbon dioxide, is delivered in stream 1315 via line 962 into the rotary dryers 95. The inert gas aids in stripping the light solvent from the light solvent-wetted sands in the rotary dryers 95. In addition, the inert gas in stream 1315 helps prevent outside air from entering through the rotary valve 970 as it operates to permit clean, dry sands in stream 1310 to exit from the rotary dryers 95.

A source of hot oil 980 delivered via line 981 to the rotary dryers 95 jackets the rotary dryers 95 and provides a source of heat to raise the temperature within the rotary dyers 95 and thereby vaporize the light solvent on the light solvent-wetted sands. The temperature of the rotary dryers is raised to 200° to 250° C.

Carbon dioxide and solvent in stream 1300 is sent via line 1320 to the rotary dryers from the heat exchanger 1290.

Nitrogen and vaporized solvent in stream 1305 is drawn from the rotary dryers 95 via line 100 and sent to the vapor solvent recovery system 105.

Clean, dry sands exit the rotary dryers 95 via rotary valves 970 operably connected to the motor 965. The clean, dry sands in stream 1310 are sent via line 102 to sands storage or, optionally, to a heat exchanger (not shown) that captures the heat of the sands to heat other fluids in the processing system 10 and, thereby, increase the energy efficiency of the processing system 10.

Figure 14:
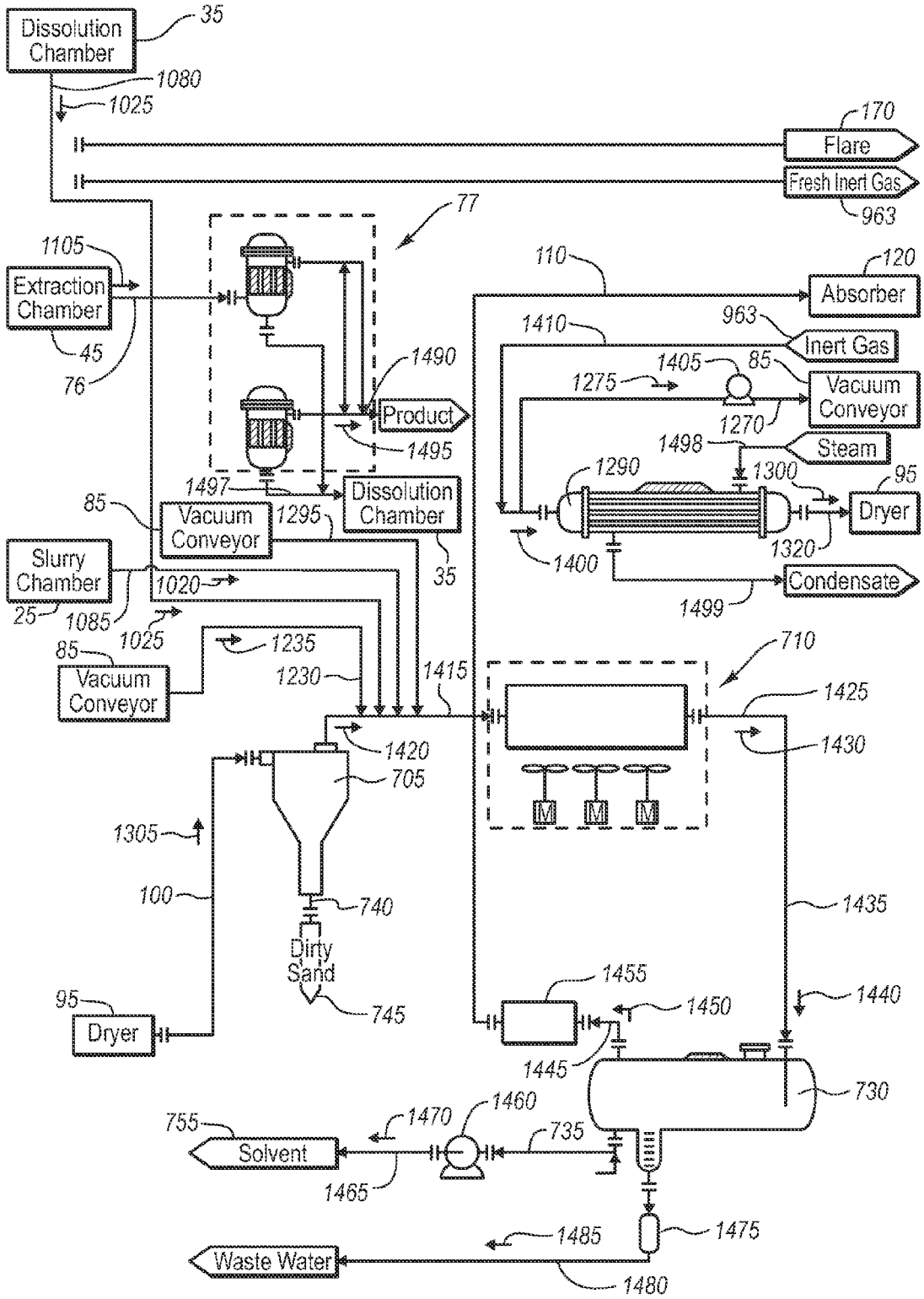
FIG. 14 an embodiment of a vapor recovery system and other components used in an example of the system.

An embodiment of the vapor solvent recovery system 105 is depicted in FIG. 14. Stream 1305 of nitrogen and solvent is sent via line 1305 from the rotary dryer 95 to the cyclonic separator 705. The cyclonic separator 705 removes sand and other sediment entrained in stream 1305, with the dry sand 745 exiting the cyclonic separator via line 740.

Stream 1305 is joined with stream 1235 sent via line 1230 from vacuum conveyor 85; line 1295 from vacuum conveyor 85; stream 1025 via line 1080 from dissolution chamber 35; and, stream 1020 via line 1085 from slurry chamber 25. Together, the aforementioned streams combine to form stream 1420 in line 1415.

Stream 1420 enters a cooler 710 that includes motors and fans to cool stream 1420.

Stream 1430 exits from the cooler 710 via line 1425, which intersects line 1435 in which stream 1440 is sent to receiver 730.

From receiver 730, waste water stream 1485 is drawn off via drum 1475 and delivered via line 1480 to storage or further treatment.

Stream 1470 is drawn off from receiver 730 via line 735. Pump 1460 urges stream 1470 via line 1465 to solvent storage 755 or, optionally, to the solvent recovery system 735.

Nitrogen and solvent in stream 1450 is drawn off from receiver 730 via line 1445. Stream 1450 is compressed in compressor 1455 and sent via line 110 to the solvent absorber system 120.

Also illustrated within FIG. 14, although not part of the vapor solvent recovery system 105, is the heat exchanger 1290, previously discussed in FIG. 12. Inert gas, such as nitrogen, from source 963, enters the heat exchanger 1290 via line 1410. Line 1270 carries stream 1275, as urged by pump 1405, to the vacuum conveyor 85. Line 1320 carries stream 1300 to the rotary dryer 95. Finally, steam enters the heat exchanger 1290 via line 1498 while condensate leaves the heat exchanger 1290 via line 1499.

Also depicted in FIG. 14, but also not part of the vapor solvent recovery system 105, is the filter 77. Line 76 delivers stream 1105 from the extraction chamber, or vessel, 45. After passing through the filter 77, bitumen in stream 1495 leaves via line 1490 for storage or further processing, while some bitumen leaves via line 1497 to the dissolution chamber 35.

Additionally, a method of processing oil sands in an extraction chamber or vessel is disclosed as an embodiment of the invention. The method includes preparing a slurry of bitumen rich oil sands and solvent, which can be water (hot or cold) and/or hydrocarbon based, mixtures thereof, or other solvents, in a slurry chamber and/or dissolution chamber as discussed above. An extraction chamber or vessel is provided into which a slurry of bitumen rich oil sands and solvents is injected into the upper portion of the chamber, typically, but not necessarily, the top third. The extraction chamber is provided with a plurality of trays and scrapers in a stacked, vertical arrangement. Each tray has an associated scraper adjacent thereto.

A motor is provided that is coupled to at least one of the trays and the scrapers and provides a relative rotation between each tray and its associated scraper. The trays have one or more openings, with the relative rotation of each tray and its associated scraper urging the slurry towards the opening through which the slurry falls under the force of gravity to the next lower tray in the vertical stack.

One or more sprayers or spargers are provided, through which additional solvent is injected into the extraction chamber as described above. Typically, the solvent is water and/or a hydrocarbon based solvent. In one embodiment, a first sprayer injects a heavy solvent, such as an aromatic, into the extraction chamber, which is further mixed through the slurry through the action of the relative rotation of the trays and scrapers.

Optionally a second sprayer or sparger is provided, through which additional solvent of the same type or different type as the type that is injected in the first sprayer is injected into the extraction chamber. In one embodiment, a light solvent, such as a paraffinic solvent is injected through the second sprayer.

Bitumen released from the formerly bitumen rich sands rises upward through the extraction chamber, along with the heavy solvent, in a froth that is drawn off through a provided line or conduit proximate the top of the extraction chamber.

Sands, typically solvent wetted and, more typically, light solvent-wetted sands pass through a provided valve proximate the bottom of the extraction chamber. The valve is selectively operable and configured to pass the light solvent-wetted sands from the extraction chamber to a dryer without substantially admitting ambient air and/or substantially allowing hydrocarbons and vapors to escape to the external environment.

The one or more present inventions, in various embodiments, includes components, methods, processes, systems and/or apparatus substantially as depicted and described herein, including various embodiments, subcombinations, and subsets thereof Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An extraction chamber configured for separating bitumen from a slurry of bitumen rich sands, bitumen, and solvent comprising:

a vessel including a top and a bottom, said vessel configured to receive said slurry in said vessel;

a plurality of trays spaced apart in a vertically stacked configuration inside said vessel, wherein each tray of said plurality of trays has a plurality of openings in a surface of each tray in which said openings of each tray are rotationally offset from said openings of each adjacent tray, and wherein said slurry is deposited on the uppermost tray of said plurality of trays each of said plurality of trays including at least one scraper adjacent thereto;

a motor coupled to at least one of said plurality of trays and one of said scrapers, said motor configured to provide a relative rotational movement between said scrapers and said trays to urge said slurry through said opening of said tray to deposit said slurry in a lower position within said vessel;

a sprayer for injecting into said slurry a solvent selected to substantially remove said bitumen from said bitumen rich sands and leaving substantially bitumen free sands;

a conduit proximate said top of said vessel through which said bitumen is removed; and, a valve proximate said bottom configured to selectively open and allow said substantially bitumen free sands to exit said vessel.

2. The extraction chamber of claim 1, wherein said slurry enters said vessel through a port configured to impart said slurry with an angular momentum relative to a centerline of said vessel.

3. The extraction chamber of claim 1, wherein said solvent is heavy solvent.

4. The extraction chamber of claim 3, wherein said heavy solvent is an aromatic hydrocarbon.

5. The extraction chamber of claim 4, further comprising a second sprayer positioned below said sprayer in said vessel, wherein said second sprayer is for injecting a second solvent.

6. The extraction chamber of claim 5, wherein said second solvent is a light solvent.

7. The extraction chamber of claim 6, wherein said light solvent is a paraffinic hydrocarbon.

8. The extraction chamber of claim 1, wherein said valve substantially prevents air from entering and volatile hydrocarbons from escaping said vessel, said valve configured to selectively open and allow said substantially bitumen free sands to exit said vessel and enter a dryer configured to substantially prevent air from entering and volatile hydrocarbons from escaping said dryer.

9. The extraction chamber of claim 1, wherein said vessel is jacketed to heat said vessel to a temperature in a range of about 20° C. to about 100° C.

10. The extraction chamber of claim 9, wherein said temperature is in a range of about 40° C. to about 80° C.

11. The extraction chamber of claim 1, wherein said vessel is at an internal pressure in a range of about 1½ to about 5 times ambient pressure.

12. The extraction chamber of claim 11, wherein said pressure is in a range of about 2 to about 4 times ambient pressure.

13. An extraction chamber configured for separating bitumen from a slurry of bitumen rich sands, bitumen, and solvent comprising:

a vessel including a top and a bottom, said vessel configured to receive said slurry in said vessel;

a plurality of trays spaced apart in a vertically stacked configuration inside said vessel, wherein each tray of said plurality of trays has a plurality of openings in a surface of each tray in which said openings of each tray are rotationally offset from said openings of each adjacent tray, and wherein said slurry is deposited on the uppermost tray of said plurality of trays each of said plurality of trays including at least one scraper adjacent thereto;

a motor coupled to at least one of said plurality of trays and one of said scrapers, said motor configured to provide a relative rotational movement between said scrapers and said trays to urge said slurry through said opening of said tray to deposit said slurry in a lower position within said vessel;

a first sprayer positioned at a first injection location in said vessel for injecting into said slurry a heavy solvent selected to substantially remove said bitumen from said bitumen rich sands to leave heavy solvent-wetted sands substantially free of bitumen;

a second sprayer positioned at a second injection location below said first injection location in said vessel for injecting into said slurry a light solvent selected to substantially remove said light solvent from said heavy solvent-wetted sands and leaving light solvent-wetted sands;

a conduit proximate said top of said vessel through which said bitumen is removed; and, a valve proximate said bottom of said vessel configured to selectively open and allow said substantially light solvent-wetted sands to exit said vessel.

14. The extraction chamber of claim 13, wherein said slurry enters said vessel through a port configured to impart said slurry with an angular momentum relative to a centerline of said vessel.

15. The extraction chamber of claim 13, wherein said heavy solvent is an aromatic hydrocarbon.

16. The extraction chamber of claim 13, wherein said light solvent is a paraffinic hydrocarbon.

17. The extraction chamber of claim 13, wherein said valve substantially prevents air from entering and volatile hydrocarbons from escaping said vessel, said valve configured to selectively open and allow said substantially bitumen free sands to exit said vessel and enter a dryer configured to substantially prevent air from entering and volatile hydrocarbons from escaping said dryer.

18. The extraction chamber of claim 13, wherein said vessel is jacketed to heat said vessel to a temperature in a range of about 40° C. to about 80° C.

19. The extraction chamber of claim 13, wherein said vessel is at an internal pressure in a range of about 2 to about 4 times ambient pressure.

20. A closed extraction chamber configured for separating bitumen from a slurry of bitumen rich sands, bitumen, and solvent that substantially prevents air from entering and volatile hydrocarbons from escaping the extraction chamber comprising:

a vessel including a top and a bottom, said vessel configured to receive said slurry in said vessel;

a plurality of trays spaced apart in a vertically stacked configuration inside said vessel, wherein each tray of said plurality of trays has a plurality of openings in a surface of each tray in which said openings of each tray are rotationally offset from said openings of each adjacent tray, and wherein said slurry is deposited on the uppermost tray of said plurality of trays each of said plurality of trays including at least one scraper adjacent thereto;

a motor coupled to at least one of said plurality of trays and one of said scrapers, said motor configured to provide a relative rotational movement between said scrapers and said trays to urge said slurry through said opening of said tray to deposit said slurry in a lower position within said vessel;

a sprayer for injecting into said slurry a solvent selected to substantially remove said bitumen from said bitumen rich sands and leaving substantially bitumen free sands;

a conduit proximate said top of said vessel through which said bitumen is removed; and, a valve proximate said bottom of said vessel that substantially prevents air from entering and volatile hydrocarbons from escaping said vessel, said valve configured to selectively open and allow said substantially bitumen free sands to exit said vessel and enter a dryer configured to substantially prevent air from entering and volatile hydrocarbons from escaping said dryer.

21. The closed extraction chamber of claim 20, wherein said slurry enters said vessel through a port configured to impart said slurry with an angular momentum relative to a centerline of said vessel.

22. The closed extraction chamber of claim 20, wherein said solvent is heavy solvent.

23. The closed extraction chamber of claim 22, wherein said heavy solvent is an aromatic hydrocarbon.

24. The closed extraction chamber of claim 23, further comprising a second sprayer positioned below said sprayer in said vessel, wherein said second sprayer is for injecting a second solvent.

25. The closed extraction chamber of claim 24, wherein said second solvent is a light solvent.

26. The closed extraction chamber of claim 25, wherein said light solvent is a paraffinic hydrocarbon.

27. The closed extraction chamber of claim 20, wherein said vessel is jacketed to heat said vessel to a temperature in a range of about 40° C. to about 80° C.

28. The closed extraction chamber of claim 20, wherein said vessel is at an internal pressure in a range of about 2 to about 4 times ambient pressure.

29. A method of removing bitumen from a slurry of bitumen rich sands, bitumen, and solvent comprising:

providing a vessel that includes a top and a bottom, said vessel configured to receive said slurry in said vessel;

providing a plurality of trays spaced apart in a vertically stacked configuration inside said vessel, wherein each tray of said plurality of trays has a plurality of openings in a surface of each tray in which said openings of each tray are rotationally offset from said openings of each adjacent tray, each of said plurality of trays including at least one scraper adjacent thereto;

providing a motor coupled to at least one of said plurality of trays and one of said scrapers, said motor configured to provide a relative rotational movement between said scrapers and said trays to urge said slurry through said opening of said tray to deposit said slurry in a lower position within said vessel;

providing a sprayer for injecting into said slurry a solvent selected to substantially remove said bitumen from said bitumen rich sands and leaving substantially bitumen free sands;

providing a conduit proximate said top of said vessel through which said bitumen is removed;

providing a valve proximate said bottom configured to selectively open and allow said substantially bitumen free sands to exit said vessel;

depositing a slurry on the uppermost tray of said plurality of trays;

rotating each of said trays relative to the adjacent scraper of each tray;

injecting said solvent into said slurry;

removing said bitumen removed from said bitumen rich sands;

removing said bitumen from said vessel through said conduit; and, selectively opening said valve to allow said substantially bitumen free sands to exit said vessel.

30. The method of claim 29, wherein said slurry enters said vessel through a port configured to impart said slurry with an angular momentum relative to a centerline of said vessel.

31. The method of claim 29, wherein said solvent is heavy solvent.

32. The method of claim 31, wherein said heavy solvent is an aromatic hydrocarbon.

33. The method of claim 32, further comprising:

providing a second sprayer positioned below said sprayer in said vessel, wherein said second sprayer is for injecting a second solvent; and, injecting said second solvent into said slurry.

34. The method of claim 33, wherein said second solvent is a light solvent.

35. The method of claim 34, wherein said light solvent is a paraffinic hydrocarbon.

36. The method of claim 29, wherein said valve substantially prevents air from entering and volatile hydrocarbons from escaping said vessel, said valve configured to selectively open and allow said substantially bitumen free sands to exit said vessel and enter a dryer configured to substantially prevent air from entering and volatile hydrocarbons from escaping said dryer.

37. The method of claim 29, further comprising heating said vessel to a temperature in a range of about 40° C. to about 80° C.

38. The method of claim 29, holding said vessel at an internal pressure in a range of about 2 to about 4 times ambient pressure.

* * * * *